US008559861B2

(12) United States Patent
Lee et al.

(10) Patent No.: US 8,559,861 B2
(45) Date of Patent: Oct. 15, 2013

(54) FIXING DEVICE AND IMAGE FORMING APPARATUS HAVING THE SAME

(75) Inventors: Jin-sung Lee, Seoul (KR); Seong-yul Kim, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 172 days.

(21) Appl. No.: 13/011,993

(22) Filed: Jan. 24, 2011

(65) Prior Publication Data

US 2012/0008971 A1 Jan. 12, 2012

(30) Foreign Application Priority Data

Jul. 9, 2010 (KR) ..... 10-2010-0066420

(51) Int. Cl.
*G03G 15/20* (2006.01)

(52) U.S. Cl.
USPC ..... 399/329; 399/69; 399/328

(58) Field of Classification Search
USPC ..... 399/33, 69, 122, 329
See application file for complete search history.

(56) References Cited

U.S. PATENT DOCUMENTS

| | | | | |
|---|---|---|---|---|
| 6,937,827 | B2 * | 8/2005 | Katoh et al. | 399/68 |
| 7,113,716 | B2 * | 9/2006 | Tomatsu | 399/67 |
| 7,502,585 | B2 * | 3/2009 | Uehara et al. | 399/329 |
| 7,860,442 | B2 * | 12/2010 | Nishikawa et al. | 399/329 |
| 8,150,305 | B2 * | 4/2012 | Shin | 399/329 |
| 8,160,484 | B2 * | 4/2012 | Hasegawa et al. | 399/329 |
| 2009/0208264 | A1 * | 8/2009 | Fujiwara et al. | 399/329 |
| 2010/0232822 | A1 * | 9/2010 | Takenaka et al. | 399/69 |
| 2011/0020018 | A1 * | 1/2011 | Takenaka et al. | 399/33 |
| 2011/0058864 | A1 * | 3/2011 | Fujimoto et al. | 399/329 |
| 2011/0064443 | A1 * | 3/2011 | Iwaya et al. | 399/69 |
| 2011/0116848 | A1 * | 5/2011 | Yamaguchi et al. | 399/329 |

FOREIGN PATENT DOCUMENTS

| | | | |
|---|---|---|---|
| JP | 2005-283927 | | 10/2005 |
| JP | 2006113179 | A * | 4/2006 |
| JP | 2008-145903 | | 6/2008 |
| JP | 2010-032625 | | 2/2010 |

* cited by examiner

*Primary Examiner* — David Gray
*Assistant Examiner* — Carla Therrien
(74) *Attorney, Agent, or Firm* — Stanzione & Kim, LLP

(57) ABSTRACT

A fixing device includes a fixing belt to transmit a heat to a print medium, a pressing unit to apply a pressure on the print medium, a heating unit surrounded by the fixing belt to generate the heat and a nip plate disposed against the fixing belt and facing the pressing unit, to form a fixing nip. The fixing device further includes a support element to support the nip plate, and a reflection unit disposed within the fixing belt to reflect the heat radiated from the heating unit toward the support element. The reflection unit is connected to the nip plate to conduct the heat from the reflection unit to the nip plate.

23 Claims, 34 Drawing Sheets

FIXING DEVICE AND IMAGE FORMING APPARATUS HAVING THE SAME

CROSS-REFERENCE TO RELATED APPLICATIONS

This application claims priority under 35 U.S.C. §119(a) from Korean Patent Application No. 10-2010-66420, filed Jul. 9, 2010, in the Korean Intellectual Property Office, the disclosure of which is incorporated herein by reference in its entirety.

BACKGROUND

1. Field of the Invention

Apparatuses consistent with the present general inventive concept relate to an image forming apparatus. More specifically, the present general inventive concept relates to a fixing device, which is used in the image forming apparatus.

2. Description of the Related Art

An image forming apparatus, such as a printer, a facsimile, a copier, a multifunction unit (MFU), or the like, forms an image on a print medium by using electrophotography. In general, to form the image, the image forming apparatus performs an electric charging process, a light exposing process, an image developing process, an image transferring process, and an image fixing process. In the electric charging process, a charging unit charges a photosensitive body with a given potential. In the light exposing process, an optical scanning unit scans a light onto the photosensitive body charged with the given potential thus to form an electrostatic latent image corresponding to print data on the photosensitive body. In the image developing process, a developing unit supplies a toner onto the photosensitive body on which the electrostatic latent image is formed, thus to form a toner image on the photosensitive body. In the image transferring process, a transfer unit transfers the toner image formed on the photosensitive body onto the print medium. In the fixing process, a fixing device fixes the toner image transferred onto the print medium thus to form the image on the print medium. After that, the print medium is discharged to the outside of the image forming apparatus, and the print operation is completed.

In general, the fixing device applies a heat and a pressure onto the print medium to fix the unfixed toner on the print medium. Accordingly, the fixing device includes a heating unit, which consumes a considerable amount of electric power to generate the heat. Actually, the fixing device may consume more than 50% of an entire amount of electric power consumption of the image forming apparatus. Thus, it is desirable to provide a fixing device that uses the heat generated from the heating unit as efficiently as possible.

Even though the image forming apparatus is turned on, the fixing device does not fix the unfixed toner immediately, and requires a warm-up time during which the fixing device reaches a temperature that effectively fixes the unfixed toner. Since waiting for a warm-up time causes an inconvenience to a user, it is necessary to reduce the warm-up time.

In addition, if a fixedness of the toner is deteriorated, the toner may get on a user's hands when the print medium that finishes print process is rubbed with the user's hands. Thus, it is also necessary to improve the fixedness of the toner.

As described above, there is a need to develop a fixing device able to satisfy all of conditions, which reduce the electric power consumption, reduce the warm-up time, and enhance the fixedness of the toner.

SUMMARY

Exemplary embodiments of the present general inventive concept overcome the above disadvantages and other disadvantages not described above. Also, the present general inventive concept is not required to overcome the disadvantages described above, and an exemplary embodiment of the present general inventive concept may not overcome any of the problems described above.

Additional features and utilities of the present general inventive concept will be set forth in part in the description which follows and, in part, will be obvious from the description, or may be learned by practice of the present general inventive concept.

The present general inventive concept provides a fixing device and an image forming apparatus having the same, which can reduce electric power consumption, reduce a warm-up time, and enhance a fixedness of a toner.

According to one feature of the present general inventive concept, a fixing device includes a fixing belt to transmit a heat to a print medium; a pressing unit to apply a pressure on the print medium; a heating unit disposed surrounded by the fixing belt to generate the heat; a nip plate disposed against an inner surface of the fixing belt to face the pressing unit, thus to form a fixing nip; a support element to support the nip plate; and a reflection unit disposed against an inner surface of the fixing belt to reflect the heat radiated toward the support element from the heating unit, wherein the reflection unit is connected with the nip plate to conduct the heat from the reflection unit to the nip plate.

A coating layer may be formed on a surface of the nip plate coming in contact with the fixing belt to reduce a friction therebetween.

The coating layer of the nip plate may be a Teflon coating layer.

The nip plate may be formed of aluminum.

The support element may be formed of a nonmetallic material with low thermal conductivity.

The reflection unit may include a reflection plate to cover the support element, and a first space may be formed between the reflection plate and the support element.

A surface of the reflection plate toward the heating unit may be mirror-like-finished.

A reflection coating layer may be formed on the surface of the reflection plate toward the heating unit.

The reflection coating layer of the reflection plate may be a Ni coating layer or a Ni—Cr coating layer.

An insulation material may be disposed in the first space.

The fixing device may further include a reinforcement frame to reinforce a stiffness of the support element.

The reflection unit may include a reflection layer formed on a surface of the reinforcement frame toward the heating unit.

The reflection layer may be a Ni-coating layer or a Ni—Cr coating layer.

The reinforcement frame may cover a surface of the support element facing the heating unit.

The reinforcement frame may be formed of one selected from a group consisting of a steel, a steel use stainless (SUS), an aluminum, a copper and a combination thereof.

A second space may be formed between the reinforcement frame and the support element.

An insulation material may be disposed in the second space.

The fixing device may further include a sensor unit to measure a temperature of the fixing belt; and a control unit to control the heating unit based on the temperature of the fixing belt measured by the sensor unit.

The sensor unit may measure a temperature of an inner circumferential surface of the fixing belt, and the reflection unit may cut off a heat radiated toward the sensor unit from the heating unit.

The sensor unit may include a temperature measuring part disposed to penetrate through the support element and the nip plate and to come in contact with the inner circumferential surface of the fixing belt; and a signal connecting line to connect the temperature measuring part and the control unit.

The heating unit may include a plurality of heating lamps, and the plurality of heating lamps may include a first heating lamp and a second heating lamp, a filament of the first heating lamp being wound in a first section, which corresponds to a portion of the print medium in a width direction of the print medium, and a filament of the second heating lamp being wound in a second section except the first section.

According to another feature of the present general inventive concept, an image forming apparatus includes a photosensitive body, a charging roller to electrify the photosensitive body, an optical scanning unit to scan a light onto the photosensitive body thus to form an electrostatic latent image on the photosensitive body, a developing unit to supply a toner onto the photosensitive body on which the electrostatic latent image is formed, thus to form a toner image on the photosensitive body, a transfer unit to transfer the toner image formed on the photosensitive body onto the print medium, and a fixing device having characteristics as described above.

According to another feature, a heating unit includes a first heating lamp including a first filament; a second heating lamp including a second filament, each of the first and second filaments having at least one first portion and at least one second portion different from the first portion, the at least one first portion of the first filament being wound and the at least second portion of the first filament being linear; and the at least one first portion of the second filament being linear and the at least second portion of the second filament being wound.

In another feature, a heating lamp, comprising a first bulb to generate heat and including a first filament having a plurality of coiled portions and a plurality of linear portions, and a second bulb to generate heat and including a second filament having a plurality of coiled portions and a plurality of linear portions.

In still another feature, an image forming apparatus comprising a fixing belt including a hollow opening to define an inner surface to receive heat and outer surface to transmit the heat to a print medium, a pressing unit to contact the outer surface of the fixing belt to apply a pressure on the print medium, a nip plate disposed against the inner surface of the fixing belt and facing the pressing unit to form a fixing nip between the fixing belt and the pressing unit, a heating unit disposed in the hollow opening of the fixing belt and including first and second heating lamps to generate heat, a sensor to detect a width of the print medium entering the fixing nip, and a control module that controls at least one of the first and second heating lamps based on the width of the print medium to heat generate heat that heats the fixing belt.

In yet another feature, a method of heating a printing medium conveyed through a fixing unit, comprising conveying the printing medium to a fixing nip of the fixing unit, detecting a width of the printing medium entering the fixing nip, generating heat from a first heating lamp and inhibiting heat from a second heating lamp in response to the width of the printing medium being a first width, and generating heat from both the first heating lamp and the second heating lamp in response to the width of the printing medium being a second width different from the first width.

BRIEF DESCRIPTION OF THE DRAWINGS

The above and/or other features of the present general inventive concept will become apparent and more readily appreciated from the following description of the exemplary embodiments, taken in conjunction with the accompanying drawings, in which.

DETAILED DESCRIPTION OF THE EMBODIMENTS

Figure 1:
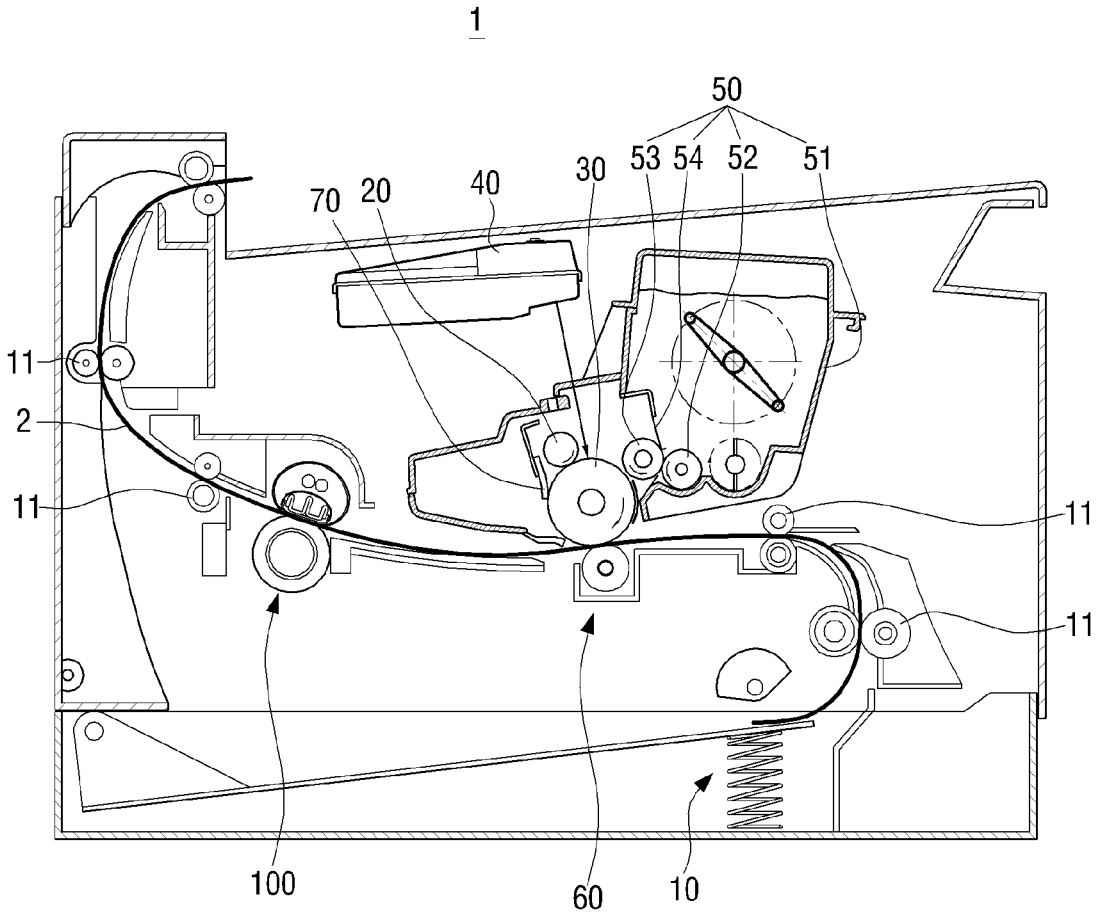
FIG. 1 is a view schematically illustrating an image forming apparatus according to an exemplary embodiment of the present general inventive concept.

Exemplary embodiments of the present general inventive concept are described in greater detail below with reference to the accompanying drawings. In the following description, well-known functions or constructions are not described in detail but omitted if they would obscure the general inventive concept with unnecessary detail. Also, to assist in a comprehensive understanding of the general inventive concept, some elements may not be shown to scale, but be exaggerated in dimensions through the accompanying drawings.

Reference will now be made in detail to exemplary embodiments of the present general inventive concept, examples of which are illustrated in the accompanying drawings, wherein like reference numerals refer to the like elements throughout. The exemplary embodiments are described below in order to explain the present general inventive concept by referring to the figures.

FIG. 1 is a view schematically illustrating an image forming apparatus 1 according to an exemplary embodiment of the present general inventive concept. This image forming apparatus 1 may be various apparatuses, such as a printer, a facsimile, a copy machine, a multifunction unit, and so on, which form an image on a print medium. In FIG. 1, a reference numeral 2 represents a traveling path of the print medium.

A paper feeding unit 10 stores print media, such as sheets of paper or the like. The print medium is conveyed along the traveling path 2 by a plurality of conveying rollers 11. A charging unit 20 charges a photosensitive body 30 with a given potential. An optical scanning unit 40 scans a light, such as a laser beam or the like, onto the photosensitive body 30 and thus forms an electrostatic latent image corresponding to print data on the photosensitive body 30.

A developing unit 50 supplies a toner onto the photosensitive body 30 on which the electrostatic latent image is formed, to form a toner image thereon. The developing unit 50 may include a toner accommodating part 51, a toner supplying roller 52, a developing roller 53 and a regulating blade 54.

The toner accommodating part 51 accommodates the toner therein. The toner supplying roller 52 supplies the toner accommodated in the toner accommodating part 51 onto the developing roller 53, and thus a toner layer is formed on the developing roller 53. The regulating blade 54 makes the toner layer be uniformly formed on the developing roller 53. The toner layer on the developing roller 53 moves onto the electrostatic latent image formed on the photosensitive body 30 due to a potential difference between the developing roller 53 and the photosensitive body 30, so that the electrostatic latent image on the photosensitive body 30 is developed to form a toner image.

A transfer unit 60 transfers the toner image formed on the photosensitive body 30 onto the print medium. A cleaning unit 70 removes a remaining toner on the photosensitive body 30 after the image transferring process is completed. A fixing device 100 fixes the toner image transferred onto the print medium. The print medium on which the toner image is fixed is discharged to the outside from the image forming apparatus 1 by the plurality of conveying rollers 11.

Figure 2A:
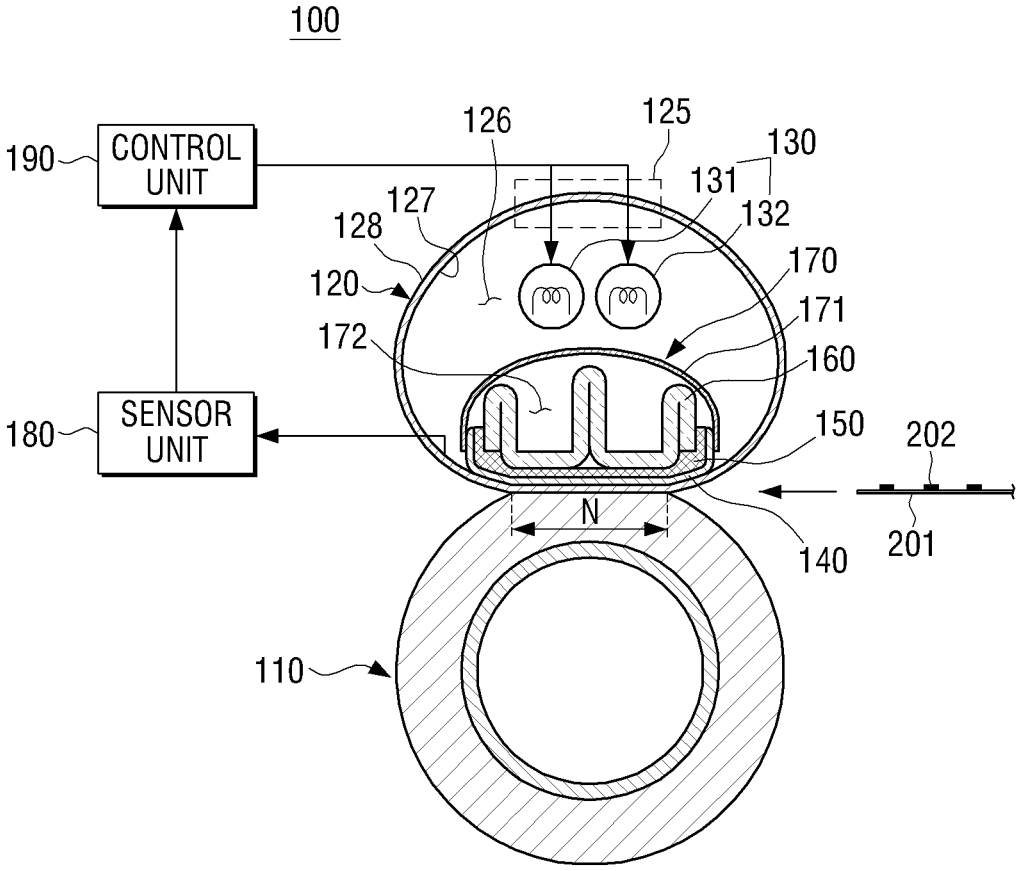
FIG. 2A is a magnified view of the fixing device illustrated in FIG. 1.

FIG. 2A is a view magnifying the fixing device 100 illustrated in FIG. 1. The fixing device 100 will be explained in detail with reference to FIG. 2A.

A fixing nip N is formed in a section in which a pressing unit 110 and a fixing belt 120 come in contact with each other. The toner 202 on the print medium 201 past the transfer unit 60 exists in an unfixed state. In the process of passing through the fixing nip N, the print medium 201 is applied with a heat and a pressure, and thus the unfixed toner 202 on the print medium 201 is fixed.

A pressing unit 110 applies the pressure on the print medium 201, which passes through the fixing nip N. The pressing unit 110 may be urged against the fixing belt 120 by a spring, which is not shown in the drawings. The pressing unit 110 may be rotated by a driving device in the image forming apparatus 1. In the exemplary embodiment, although the pressing unit 110 is constructed as a roller type, it may be also constructed as a belt type.

The fixing belt 120, generally indicated, may have a cylindrical shape having a hollow opening 126 to define an inner circumference surface 127 and an outer circumference surface 128. A heating unit 130 may be disposed in the hollow opening. The heating unit 130 generates heat that is absorbed by the fixing belt 120. Accordingly, the fixing belt 120 may transmit heat to a print medium 201, which passes through the fixing nip N. As the pressing unit 110 rotates, the fixing belt 120 may be rotated by a friction force therebetween. Unlike this, the fixing belt 120 may be also rotated by a separate driving device.

Figure 3:
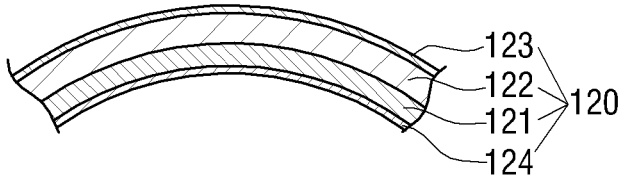
FIG. 3 is a view magnifying a fixing belt.

FIG. 3 is a view magnifying the fixing belt 120. As illustrated in FIG. 3, the fixing belt 120 may include an inner layer 121, an elastic layer 122, and an outer layer 123. In the exemplary embodiment of the present general inventive concept, the inner layer 121 is formed with a thickness of 40 μm by a steel use stainless (SUS), the elastic layer 122 is formed with a thickness of 150 μm by an elastomer material, including but not limited to, rubber, and the outer layer 123 is formed with a thickness of 30 μm by a perfluoroalkoxy (PFA). The fixing belt 120 may have, for example, an average in diameter of 30 mm. It should be understood that the construction of the fixing belt 120 as described above is merely explained by way of an example, and if necessary, it may be variously modified and embodied.

A black coating layer 124 may be formed on an inner circumferential surface of the fixing belt 120 to increase a rate of absorbing the heat generated by the heating unit 130. The black coating layer 124 may be of a thermal absorbing material including, but not limited to, polyethylene, polypropylene and polywax, Further, at least one exemplary embodiment of the present general inventive concept illustrated in FIG. 3 includes the black coating layer 124 formed on an inner surface (that is, a surface coming in noncontact with the elastic layer 122) of the inner layer 121 of the fixing belt 120. Accordingly, since the heat generated by the heating unit 130 can be effectively utilized, it is possible to reduce electric power consumption and a warm-up time of the fixing device 100.

The fixing belt 120 is disposed about the heating unit 130 to receive heat from the heating unit 130. The heating unit 130 may include various devices capable of generating the heat. As illustrated in FIG. 2A, in the exemplary embodiment of the present general inventive concept, the heating unit 130 includes a first heating lamp 131, and a second heating lamp 132. The first and the second heating lamps 132 and 132 may emit a radiation heat to heat the fixing belt 120. The first and the second heating lamps 132 and 132 are symmetrically disposed with respect to a center of the fixing nip N.

Figure 4:
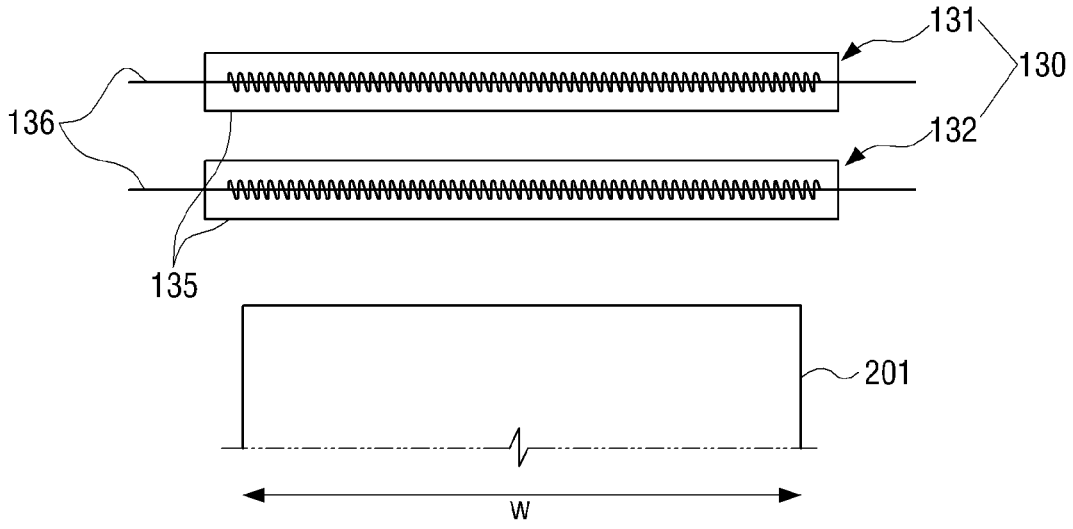
FIG. 4 is a view schematically illustrating a first heating lamp and a second heating lamp.

FIG. 4 is a view schematically illustrating the first and the second heating lamps 131 and 132. The first heating lamp 131 may be configured to include a bulb 135, and a filament 136 disposed in the bulb 135, and the second heating lamp 131 may also be configured similar to the first heating lamp 131. In the exemplary embodiment of the present general inventive concept, the filament 136 is uniformly wound in a width direction W of the print medium 201 to form a coil. Accordingly, the first and the second heating lamps 131 and 132 can emit an uniform amount of radiation heat along the width direction W of the print medium 201, thereby allowing a fixedness of the unfixed toner 202 to come uniform along the wide direction W of the print medium 201.

It should be understood that the construction of the heating unit 130 as described above is merely illustrated by way of an example, and if necessary, it may be variously modified and embodied. For example, the heating unit 130 may be made up of more than three lamps or one lamp. Also, the heating unit 130 may be configured to be disposed in various different positions.

Referring again to FIG. 2A, a nip plate 140 is disposed in the fixing belt 120 to face the pressing unit 110 and thus to allow the fixing belt 120 and the pressing unit 110 to form the fixing nip N. Since the fixing belt 120 rotates while coming in contact with the nip plate 140, it is preferable to reduce a friction between the fixing belt 120 and the nip plate 140. Accordingly, a coating layer may be formed on a surface of the nip plate 140 coming in contact with the fixing belt 120. This coating layer is preferably formed of Polytetrafluoroethylene (PTFE), also known as Teflon. In the exemplary embodiment of the present general inventive concept, the nip plate 140 may be formed from aluminum, and may have a thickness of 0.3 mm. However, this is merely explained by way of an example, and if necessary, the nip plate 140 may be variously modified and embodied.

A support element 150 supports the nip plate 140, and may include a base having a width equal to the width of the fixing nip N. While the fixing device 100 operates, some heat is transmitted to the support element 150 through the nip plate 140, so that it is not used in fixing the unfixed toner 202. Accordingly, if possible, it is preferable to reduce an amount of the heat transmitted to the support element 150 from the fixing belt 120. Accordingly, the support element 150 is preferably formed of a nonmetallic material with low thermal conductivity. For example, the support element 150 may be formed of a material, such as a plastic (for example, a liquid crystal polymer (LCP), a polyether ether ketone (PEEK) or the like), a ceramic and so on.

A reinforcement frame 160 reinforces a stiffness of the support element 150. The support element 150 may be deformed by a pressing force from the pressing unit 110, and in this case, the fixing nip N may be unevenly formed along the width direction of the print medium 201. This results in deterioration in print quality. As the reinforcement frame 160 reinforces the stiffness of the support element 150, the uniform fixing nip N can be accomplished. In the exemplary embodiment of the present general inventive concept, the reinforcement frame 160 may be made up of a plate member, which is bent at a plurality of positions. Particularly, as illustrated in FIG. 2A, the reinforcement frame 160 may have a W-shaped cross section with a flat bottom. Here, the reinforcement frame 160 was formed by bending a steel plate having a thickness of 1.6 mm. The reinforcement frame 160 may be made of a material, including but not limited to, steel, a steel use stainless (SUS), an aluminum, a copper, and a combination thereof. It should be understood that this is merely explained by way of an example, and if necessary, the reinforcement frame 160 may be variously modified and embodied.

A reflection unit 170 is disposed in the fixing belt 120 and reflects a heat radiated toward the support element 150 and the reinforcement frame 160 from the heating unit 130. In conventional fixing devices, unnecessary energy consumption occurs because the heat radiated toward the support element 150 and the reinforcement frame 160 from the heating unit 130 is not used in heating the fixing belt 120. However, in the exemplary embodiment of the present general inventive concept, the heat reflected from the reflection unit 170 can heat the fixing belt 120, thereby reducing the power consumption and the warm-up time.

The reflection unit 170 is connected with the nip plate 140. If the fixing device 100 is operated over a predetermined time period, the reflection unit 170 is also heated. The reason is that a thermal reflectability of the reflection unit 170 is not 100 percent and a hot air within the fixing belt 120 can also heat the reflection unit 170. In the exemplary embodiment of the present general inventive concept, since the reflection unit 170 is connected with the nip plate 140, the heat can be conducted from the reflection unit 170 to the nip plate 140. The heat conducted to the nip plate 140 can be used in fixing the unfixed toner 202 on the print medium 201, which passes through the fixing nip N. Even if the heat conducted to the nip plate 140 cannot be used in fixing the unfixed toner 202 due to the fact that a temperature of the nip plate 140 is lower than that of the fixing belt 120 in the section of the fixing nip N, it can reduce a difference in temperature between the nip plate 140 and the fixing belt 120 in the section of the fixing nip N, thereby reducing an amount of heat transferred to the support element 150 through the nip plate 140.

As illustrated in FIG. 2A, the reflection unit 170 includes a reflection plate 171, which may cover the reinforcement frame 160 and the support element 150. To increase the thermal reflectability, a surface of the reflection plate 171 toward the heating unit 130 may have a mirror-like-finished. Alternatively, the surface of the reflection plate 171 toward the heating unit 130 may have a reflection coating layer formed thereon. Here, the reflection coating layer may be, for example, a Ni coating layer or a Ni—Cr coating layer. As the thermal reflectability of the reflection plate 171 increases, the fixing belt 120 can be effectively heated, thereby enabling the electric power consumption and the warm-up time to reduce. It should be understood that in FIG. 2A, the reflection plate 171 is illustrated as having a cross section in the form of a parabola, it may be variously modified and embodied.

In an exemplary embodiment illustrated in FIG. 2A, a first space 172 may be formed between the reflection plate 171 and the reinforcement frame 160. That is, the reflection plate 171 and the reinforcement frame 160 may be spaced apart from each other, and thus the heat is not directly transmitted from the reflection plate 171 to the reinforcement frame 160. Instead, the reflection plate 171 is connected with the nip plate 140, so that the heat can be transmitted from the reflection plate 171 to the nip plate 140. Although there is not illustrated in FIG. 2A, an insulation material may be disposed in the first space 172.

Figure 2B:
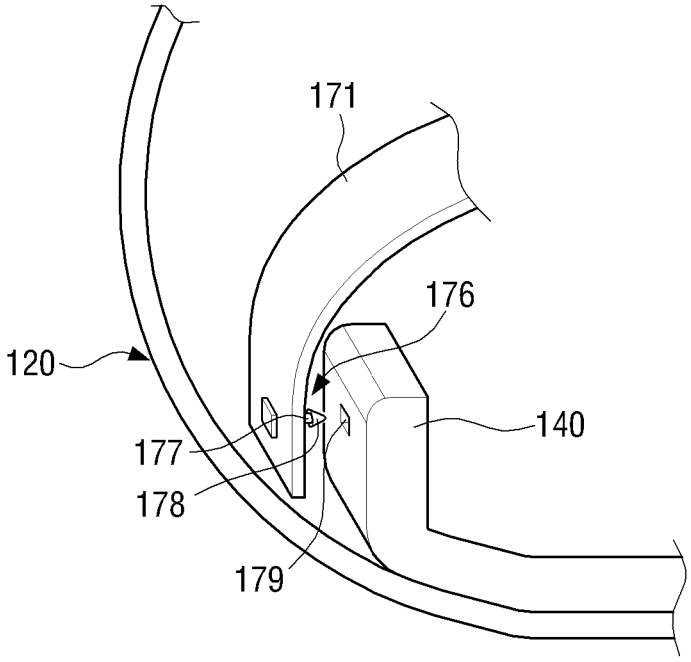
FIG. 2B is magnified view of a reflection unit according to an exemplary embodiment of the general inventive concept.

The reflection plate 171 and the nip plate 140 may be connected by using various fastening methods, such as an engagement fastening method using a hook or the like, or a screw fastening method using a screw or the like. For example, referring to an exemplary embodiment illustrated in FIG. 2B, a fastening unit 176 may include a fastener 177 integrally formed on the reflection plate 171 and having at least one hook 178 integrally formed on the fastener 177. The nip plate 140 may include a corresponding receptacle 179, such as a through-hole to receive the fastener 177. Accordingly, the hook 178 may be disposed through the receptacle 179 such that the hook 178 grips the nip plate 140, thereby coupling the reflection plate 171 thereto. Alternatively, the reflection plate 171 and the nip plate 140 may be integrally formed.

As described above, the exemplary embodiment of the present general inventive concept can effectively use the heat generated by the heating unit 130 to fix the unfixed toner 202 without unnecessary wasting, thereby enabling the electric power consumption and the warm-up time to be reduced. For example, according to results tested using the fixing device 100 in accordance with the exemplary embodiment of the present general inventive concept, it is observed that the warm-up time may be improved by approximately 75 percent.

In conventional fixing units, if an abnormal circumstance (for example, a paper jam or the like) occurs during the operation of the image forming apparatus 1, the image forming apparatus 1 may be stopped. In this case, the fixing unit 100 and the heating unit 130 are also stopped. However, as the fixing belt 120 is also stopped, an amount of heat transmitted to the print medium 201 from the fixing belt 120 is greatly reduced. Accordingly, the fixing belt 120 is heated by a hot air within the fixing belt 120. Particularly, an upper portion 125 of the fixing belt 120, that is, a portion of the fixing belt 120 over the heating unit 130 in FIG. 2A, may be greatly heated due to a convection phenomenon. According to this, the upper portion 125 of the fixing belt 120 may be damaged, and particularly, it is highly likely that the elastic layer 122 may be damaged. However, in at least one exemplary embodiment of the present general inventive concept, even if such an abnormal circumstance occurs, the heat is conducted from the reflection plate 171 to the nip plate 140 to reduce a temperature within the fixing belt 120, thereby alleviating that kind of problem.

Figure 5:
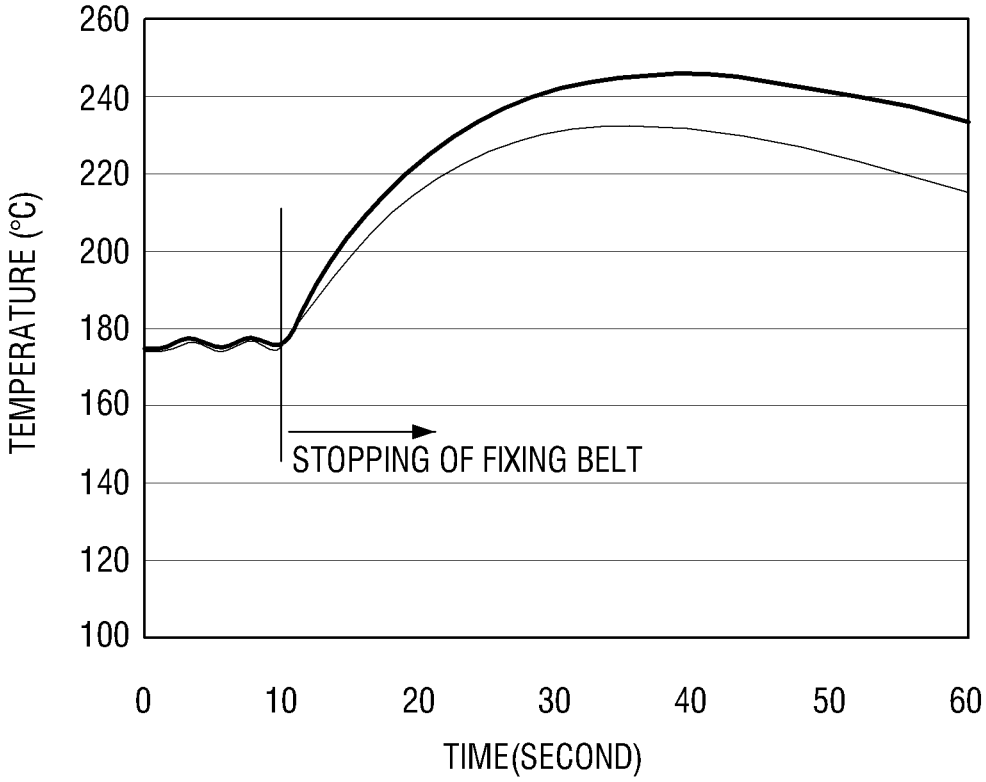
FIGS. 5 and 6 are graphs representing a temperature of an upper portion of the fixing belt when the fixing belt stops moving due to an abnormal circumstance.
Figure 6:
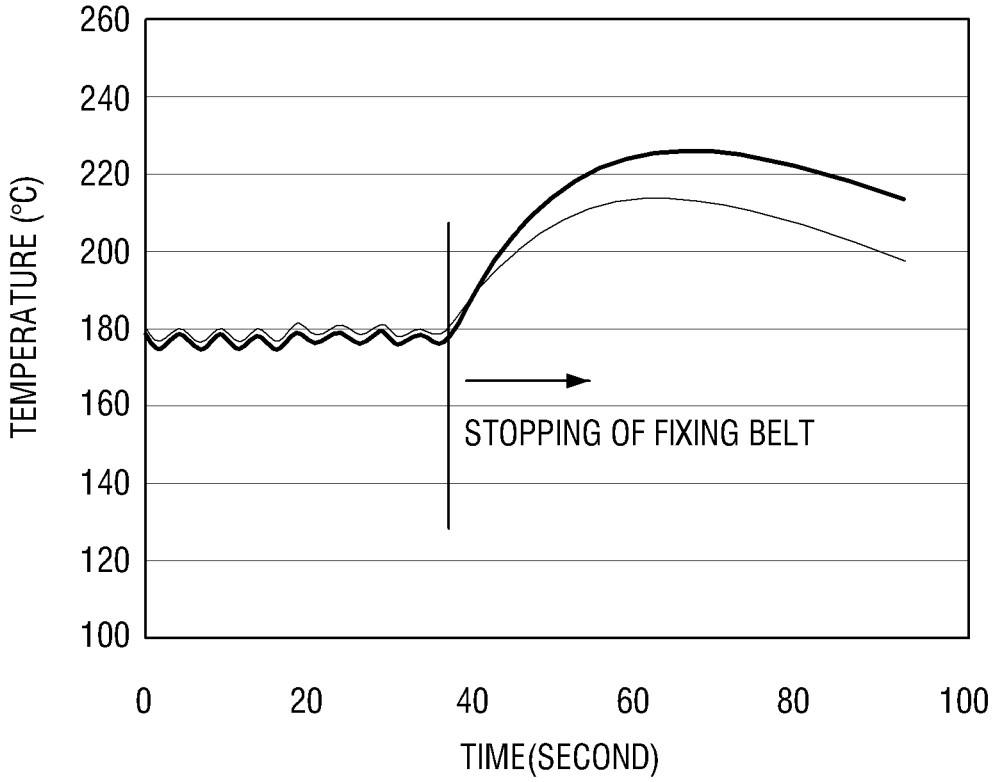

FIGS. 5 and 6 are graphs representing a temperature of the upper portion 125 of the fixing belt 120 when the fixing belt 120 stops moving due to an abnormal circumstance and/or an error of the image forming apparatus 1 and/or fixing unit 100. FIG. 5 represents a instance when the reflection plate 171 and the nip plate 140 are not connected to each other. FIG. 6 represents a case that the reflection plate 171 and the nip plate 140 are connected to each other. In FIGS. 5 and 6, a thick solid line designates a temperature in a center and upper portion 125 of the fixing belt 120 in a longitudinal direction. A thin solid line designates a temperature in an end and the upper portion 125 of the fixing belt 120 in longitudinal direction. Here, the longitudinal direction of the fixing belt 120 refers to a direction perpendicular to a drawing paper surface in FIG. 2A, which is the same direction as the width direction of the print medium 201.

As illustrated in FIGS. 5 and 6, it shows that the temperature of the upper portion 125 of the fixing belt 120 increases after the fixing belt 120 is stopped. In a first case shown in FIG. 5 where the fixing belt 120 stops, and the reflection plate 171 and the nip plate 140 are separated from each other, the temperature of the fixing belt substantially increases. If a temperature of the elastic layer 122 of the fixing belt 120 exceeds approximately 230 degrees, the elastic layer 122 may be damaged. However, in a second case where the reflection plate 171 and the nip plate 140 are coupled to each other after the fixing belt 120 stops, as shown in FIG. 6, the temperature of the fixing belt 120 is reduced and may remain below 230 degrees. Accordingly, the elastic layer 122 of the fixing belt 120 may be prevented from being damaged. As described above, according to the exemplary embodiment of the present general inventive concept, an overheating phenomenon of the fixing belt 120, which is generated when the abnormal circumstance occurs and thereby the fixing belt 120 is stopped, can be prevented.

The sensor unit 180 measures a temperture of the fixing belt 120, in conventional fixing units, an outer circumferential surface of the fixing belt 120 may be measured by contact or contactless method. If the contact method is used, the outer circumferential surface of the fixing belt 120 may be minutely scratched, thereby resulting in deterioration in print quality. If the contactless method is used, accuracy in temperture measurement may be deteriorated due to the distance between the sensor unit 180 and the fixing belt 120. In the exemplary embodiment of the present general inventive concept, however, the problems as described above can be resolved by measuring an inner circumferential surface of the fixing belt 120.

Figure 7:
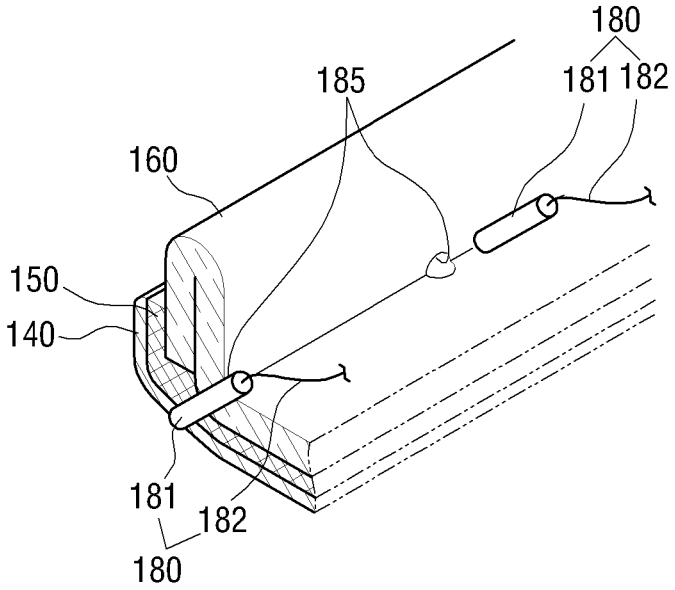
FIG. 7 is a view schematically illustrating a sensor unit.

FIG. 7 is a view illustrating the sensor unit 180 according to an exemplary embodiment of the general inventive concept. Although the sensor unit 180 is illustrated as being disposed outside the fixing belt 120 in FIG. 2A, the sensor unit 180 may be disposed within the fixing belt 120, as illustrated in FIG. 7.

The sensor unit 180 may include a temperature measuring part 181 and a signal connecting line 182. The temperature measuring part 181 is disposed to penetrate through the reinforcement frame 160, the support element 150 and the nip plate 140 and comes in contact with the inner circumferential surface 127 of the fixing belt 120. To install the temperature measuring part 181, through-holes 185 may be formed in the reinforcement frame 160, the support element 150 and the nip plate 140. The signal connecting line 182 connects the temperature measuring part 181 and the control unit 190 to or with each other. Although FIG. 7 illustrates two sensor units 180, the number of the sensor units 180 may be increased or decreased.

When the sensor unit 180 is disposed within the fixing belt 120 to measure the temperature of the inner circumferential surface 127 of the fixing belt 120, it may be damaged due to a high temperature within the fixing belt 120, and particularly, it is highly likely that the signal connecting line 182 may be damaged. However, in the exemplary embodiment of the present general inventive concept illustrated in FIG. 7, since the reflection unit 170 inhibits the heat radiated to the sensor unit 180 from the heating unit 130, damage of the sensor unit 180 due to the high temperature may be prevented even though the sensor unit 180 is disposed within the fixing belt 120.

The control unit 190 controls the heating unit 130, based on the temperature of the fixing belt 120 measured by the sensor unit 180. The temperature of the fixing belt 120 in the section of the fixing nip N can be uniformly maintained by the control unit 190, thereby maintaining a uniform fixedness of the unfixed toner 202.

Figure 8:
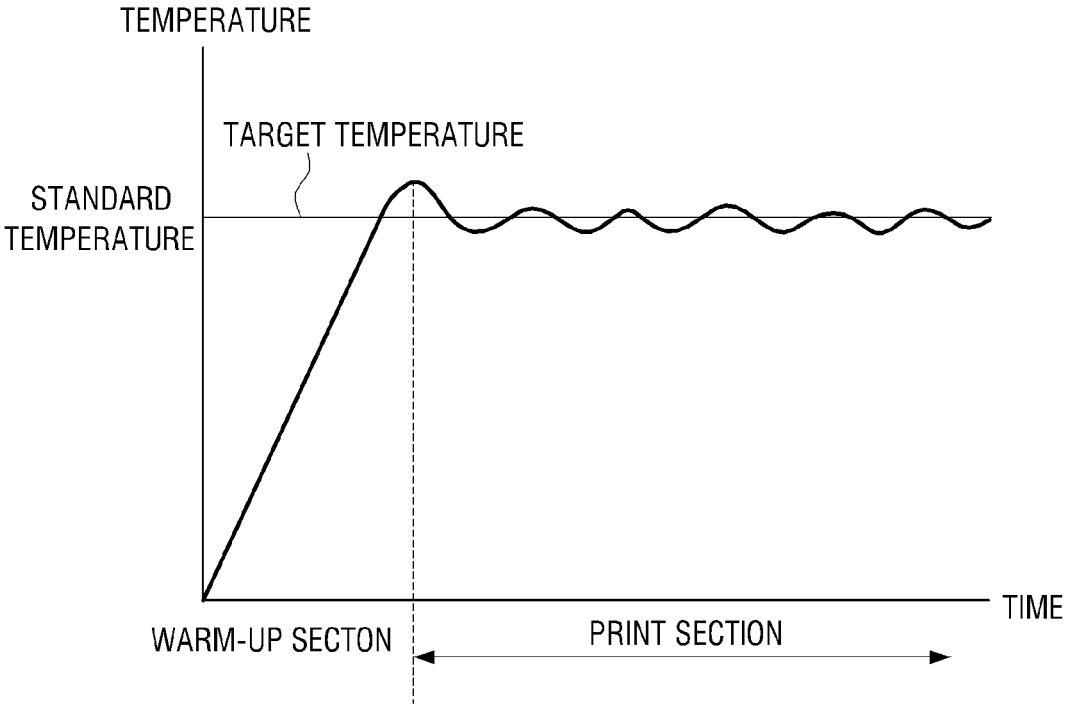
FIG. 8 is a graph representing a change in temperature of the fixing belt when a target temperature is constant.

In controlling the heating unit 130, a target temperature of the fixing belt 120 is set in the control unit 190. Referring to FIG. 8, a graph representing a change in temperature of the fixing belt 120 when the target temperature is constant is shown. For example, a target temperature indicative of the inner circumference 127 of the fixing belt 120 may be stored in the control unit 190. In FIG. 8, the target temperature was set to be the same as a standard temperature. For example, the standard temperature may be a temperature sufficient to satisfy the fixedness of the toner. In a print section, the temperature of the fixing belt 120 follows the standard temperature, but may be minutely deviated therefrom due to various factors. In a section where the temperature of the fixing belt 120 is lower than the standard temperature, a sufficient heat may be not transferred to the print medium 201, thereby deteriorating the fixedness of the unfixed toner 202.

Figure 9:
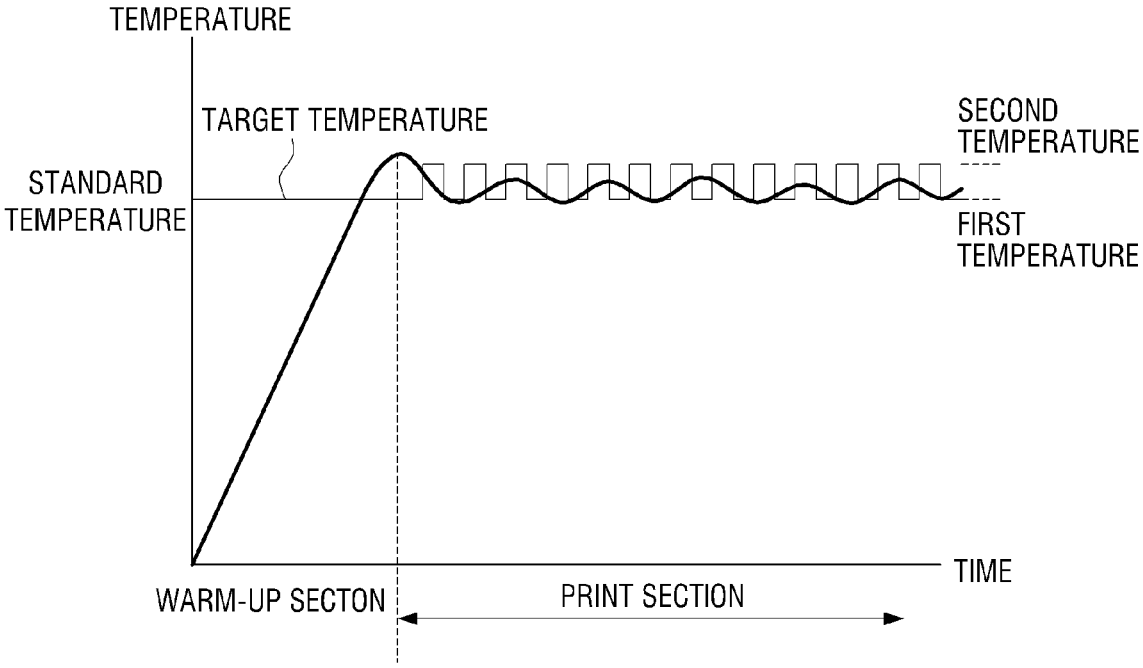
FIG. 9 is a graph representing a change in temperature of the fixing belt when the target temperature is changed.

In another exemplary embodiment of the present general inventive concept, the target temperature is set to vary over a period of time to improve the fixedness of the toner and reduce electric power consumption of the fixing unit 100. Referring to FIG. 9, a graph representing a change in temperature of the fixing belt 120 when the target temperature is changed is shown. The target temperature varies between a first temperature and a second temperature. The first temperature is set to be the same as the standard temperature, and the second temperature is set to be higher than the standard temperature. As illustrated in FIG. 9, in the print section, the temperature of the fixing belt 120 is not lower than the standard temperature, so that the fixedness of the toner can be improved. To improve the fixedness of the toner, it is possible to set the target temperature to be constant and higher than the standard temperature, but these results in unnecessary electric power consumption.

Since the toner is not fixed on the print medium 201 until the print medium 201 passes through the fixing nip N, lowering the temperature of the fixing belt 120 lower than the standard temperature does not effect on the fixedness of the toner. Accordingly, when the print medium 201 does not pass through the fixing nip N as in a warm-up section, the target temperature may be uniformly set.

In FIG. 9, a change curve of the target temperature is illustrated as having a square waveform. Alternatively, the change curve of the target temperature may have a sinusoidal waveform. Also, values of the first and the second temperatures and a change period of the target temperature may be variously modified in view of one or more variables including, but not limited to, a print speed, the type of the print medium 201, and a specification of the fixing device 100.

Figure 10:
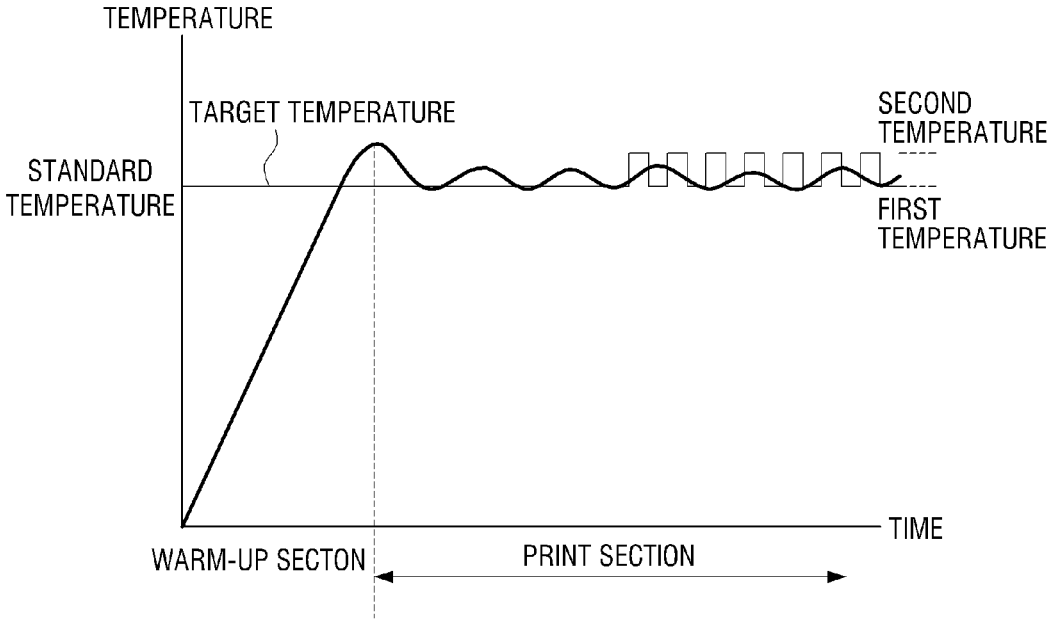
FIG. 10 is a graph representing a change in temperature of the fixing belt when a time at which the target temperature is changed is delayed.

FIG. 10 is a graph representing a change in temperature of the fixing belt 120 when a time at which a change of the target temperature is delayed. Here, the target temperature of the fixing belt 120 is changed subsequent to a time when a second print medium enters the fixing nip N after a warm-up section. Generally, since the temperature of the fixing belt 120 is rapidly increased in the warm-up section to generate an overshooting, it is less likely that the temperature of the fixing belt 120 comes to be lower than the standard temperature while a first print medium passes through the fixing nip N after the warm-up section. Accordingly, even though the time at which a change in the target temperature is delayed, the fixedness of the toner is maintained. Alternatively, the target temperature of the fixing belt 120 may be also change subsequent to a time at which a third print medium enters the fixing nip N after the warm-up section.

Figure 11:
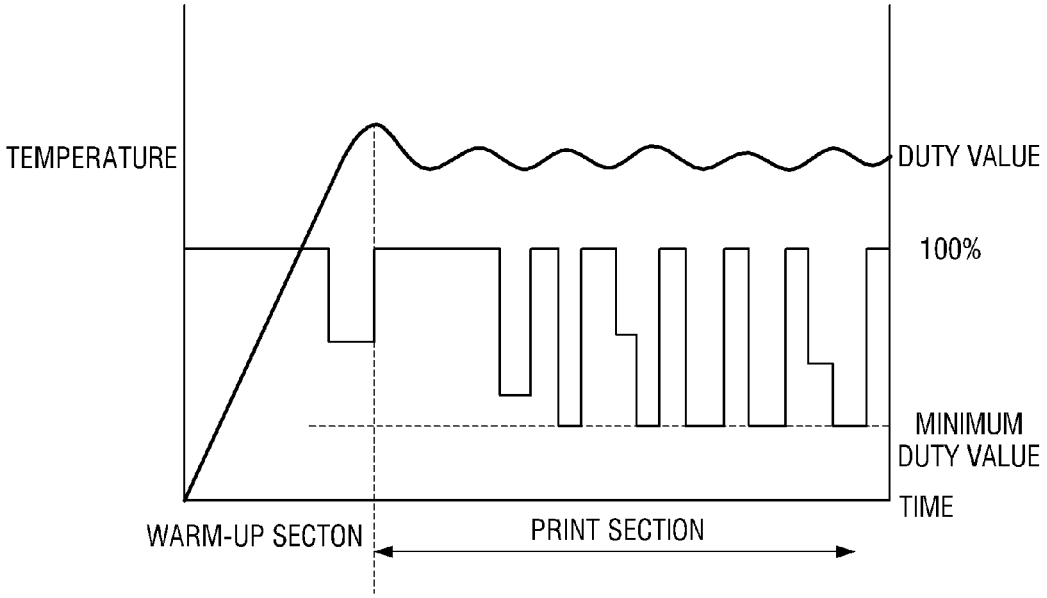
FIG. 11 is a graph representing a change in temperature of the fixing belt according to a duty control method.

In an exemplary embodiment of the present general inventive concept, the control unit 190 may control the heating unit 130 by a duty control method. FIG. 11 is a graph representing a change in temperature of the fixing belt 120 according to the duty control method. A thick solid line represents a temperature of the fixing belt 120 and a thin solid line represents a duty value. Here, it is noted that according to the duty control method, a minimum duty value is larger than 0%. If an off duty value is set to 0%, an amount of heat transmission to the fixing belt 120 is reduced, so that the fixedness of the toner may be deteriorated. In the exemplary embodiment of the present general inventive concept, the minimum duty value is set to be larger than 0%, thereby improving the fixedness of the toner.

Referring now to Tables 1 and 2, results obtained from experiments testing the fixedness of the toner according to the duty control method will be explained.

The following Table 1 represents a case where the minimum duty value is set to 0%.

TABLE 1

| $T-T_{target}$ (° C.) | More than 5 | 5~3 | 3~0 | 0~−3 | −3~−5 | −5~−10 | Less than −10 |
|---|---|---|---|---|---|---|---|
| Duty value (%) | 0 | 0 | 50 | 70 | 100 | 100 | 100 |

Figure 12:
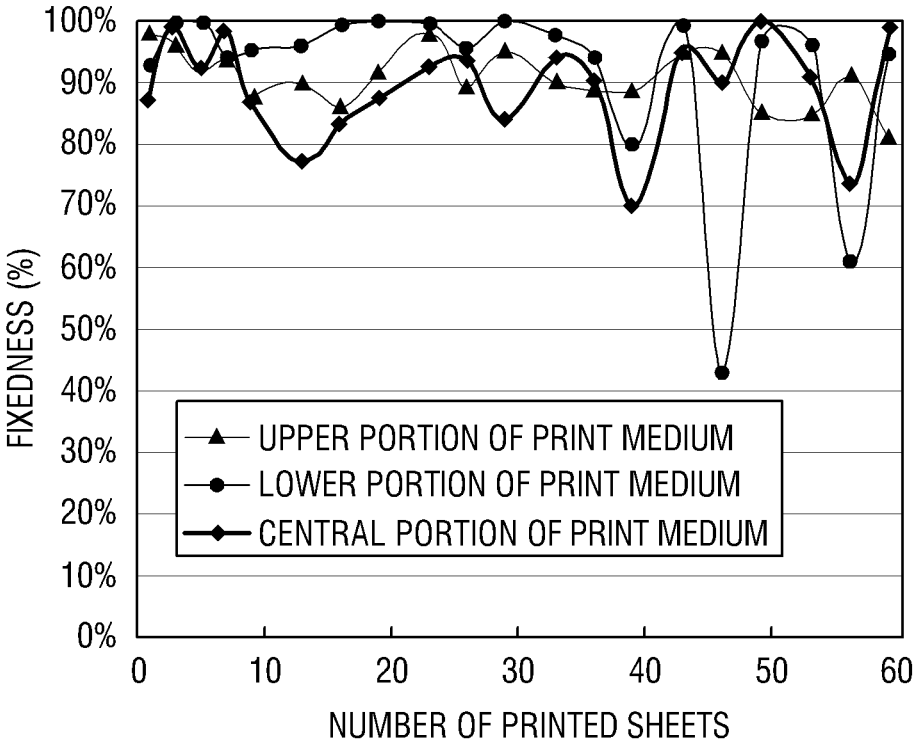
FIGS. 12 and 13 are graphs representing a change in fixedness of a toner according to the number of printed sheets.

FIG. 12 is a graph representing a change in fixedness of the toner according to the number of printed sheets based on the duty control method described in the Table 1. In this case, 60 sheets were continuously printed at a speed of 48 pages per minute (ppm). In general, if the fixedness of the toner is less than 80%, the printed sheets have a poor print quality. That is, the toner is insufficiently attached on the print medium, and a gloss of the toner is poor. Additionally, when the fixedness of the toner is less than 60%, the toner may easily be transferred to a user's hands. As can be seen from FIG. 12, the toner has a wide range of fixedness, and particularly, the fixedness of the toner in a lower portion of the print medium may become a great problem. The reason is that since a temperature of the fixing belt 120 in the section of the fixing nip N is not sufficiently high, an insufficient amount of heat is transferred to the print medium.

The following Table 2 represents a case where the minimum duty value is set to 25%.

TABLE 2

| $T-T_{target}$ (° C.) | More than 5 | 5~3 | 3~0 | 0~−3 | −3~−5 | −5~−10 | Less than −10 |
|---|---|---|---|---|---|---|---|
| Duty value (%) | 25 | 33 | 50 | 70 | 100 | 100 | 100 |

Even if the temperature of the fixing belt 120 exceeds $T_{target}$ by more than 3° C. than the target temperature, the duty value was not set to 0%. That is, if a difference between the temperature of the fixing belt 120 and the target temperature is more than 5° C., the duty value was set to 25%, and if between 3° C. and 5° C., the duty value was set to 33%.

Figure 13:
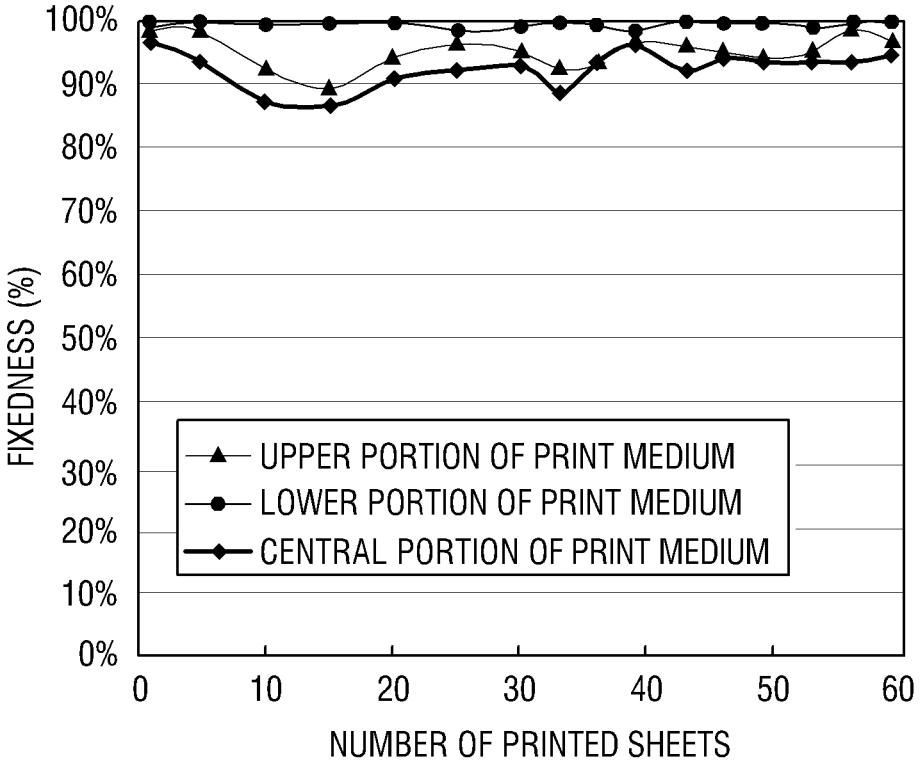

FIG. 13 is a graph representing a change in fixedness of the toner according to the number of printed sheets based on the duty control method, as described in Table 2. It can be seen that compared with FIG. 12, the toner had a considerably reduced range of fixedness, and the fixedness of the toner in all areas of the print medium came to more than 85%. As described above, as the minimum duty value is set to be larger than 0%, the fixedness of the toner and the print quality may be improved.

Figure 14:
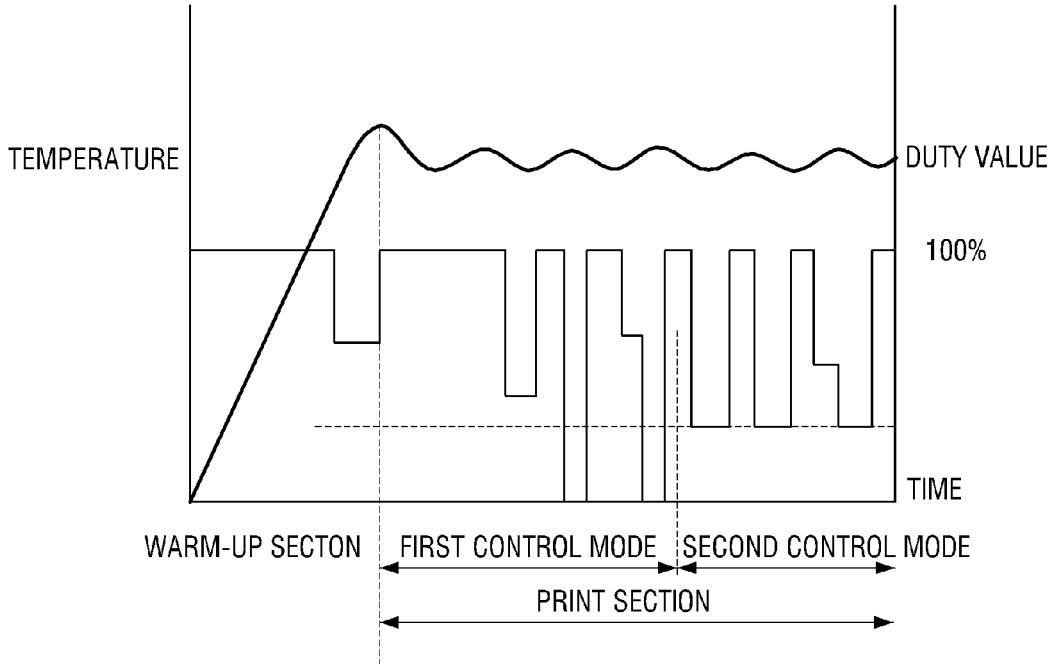
FIG. 14 is a graph representing a change in temperature of the fixing belt according to another duty control method.

FIG. 14 is a graph representing a change in temperature of the fixing belt 120 according to an alternative duty control method. Here, a first control mode where the minimum duty value is 0% and a second control mode where the minimum duty value is larger than 0 % are selectively used. If the minimum duty value is set to 0 %, the fixedness of the toner is deteriorated, whereas if it is set to be larger than 0 %, the electric power consumption is increased. Thus, by selectively using the first and the second control modes, both a reduction in electric power consumption and an improvement in fixedness can be satisfied.

As can be seen from the above tested results, the fixedness of the toner is sufficient in an early part of the print section. However, the fixedness of the toner begins to fail in a latter part of the print section. Accordingly, it is preferable that the first control mode where the minimum duty value is 0% is used in the early part of the print section, and that the second control mode where the minimum duty value is larger than 0% is used in the latter part of the print section. Alternatively, the control unit 190 may control the first and the second heating lamps 131 and 132 in a different manner. That is, the control unit 190 may control the first heating lamp 131 by using the first control mode where the minimum duty value is 0% and may control the second heating lamp 132 by using the second control mode where the minimum duty value is larger than 0%.

FIGS. 15 to 21 are views illustrating alternative embodiments of the reinforcement frame 160. Hereinafter, elements having the same function and operation as in the embodiments described above are designated as same reference numerals and detailed explanations thereof are omitted.

Figure 15:
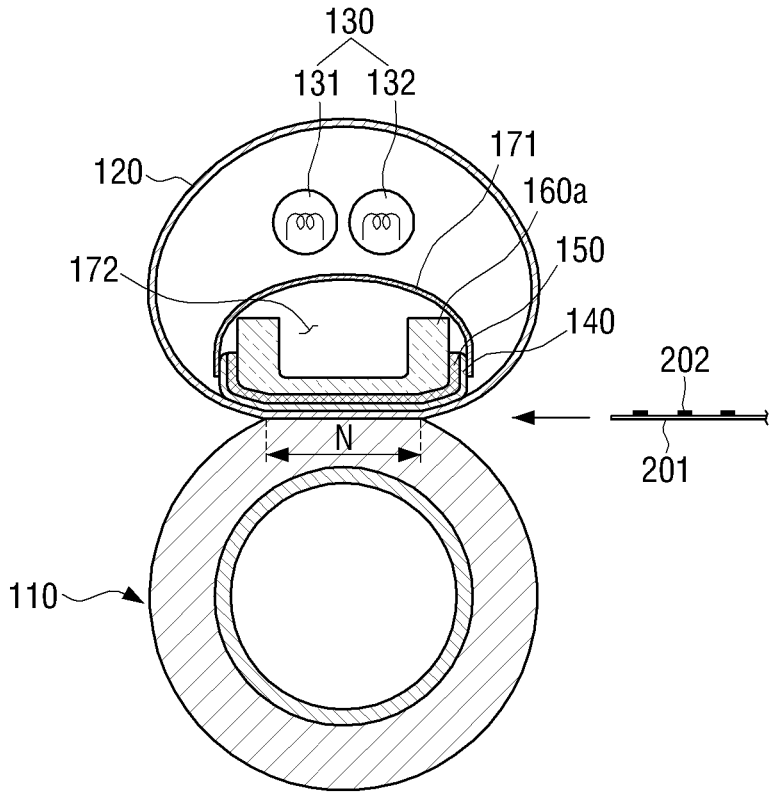
FIGS. 15 to 21 are views schematically illustrating modified embodiments of a reinforcement frame, respectively.

In FIG. 15, a reinforcement frame 160*a* has a U-shaped cross section with a flat bottom. Although the reinforcement frame 160*a* has a shape different from that of the embodiment illustrated in FIG. 2A, the reinforcement frame 160*a* may still reinforce the stiffness of the support element 150 to obtain the uniform fixing nip N.

Figure 16:
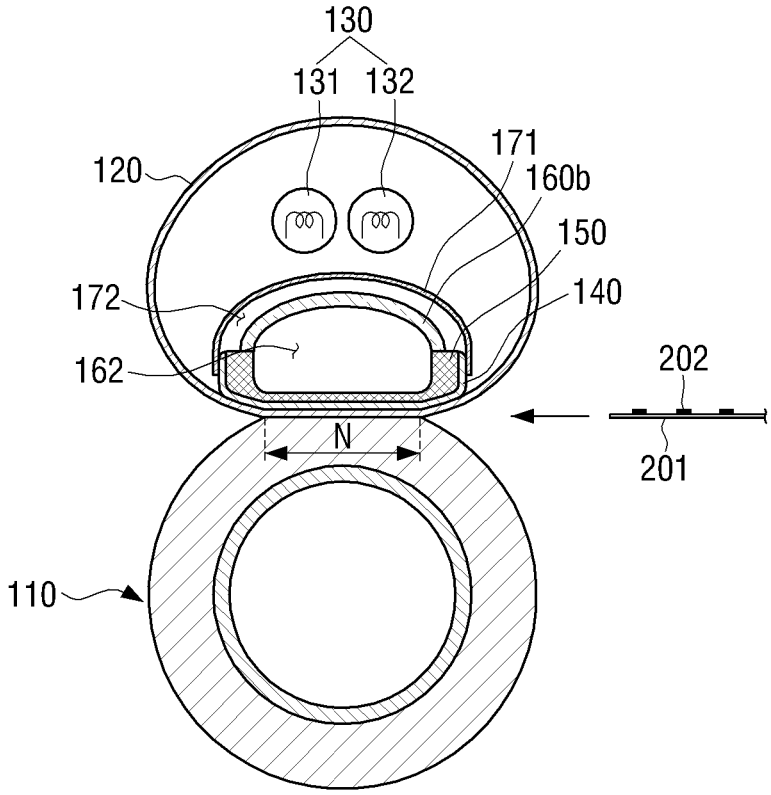

In FIG. 16, a reinforcement frame 160*b* has a reversed U-shaped cross section and is disposed to minimize an area contacting the support element 150. That is, a second space 162 is formed between the reinforcement frame 160*b* and the support element 150. In this case, since the heat conducted to the reinforcement frame 160*b* from the support element 150 is minimized, a temperature drop of the fixing belt 120 in the section of the fixing nip N may be prevented. Although there is not illustrated in FIG. 16, an insulation material may be also disposed in the second space 162.

Figure 17:
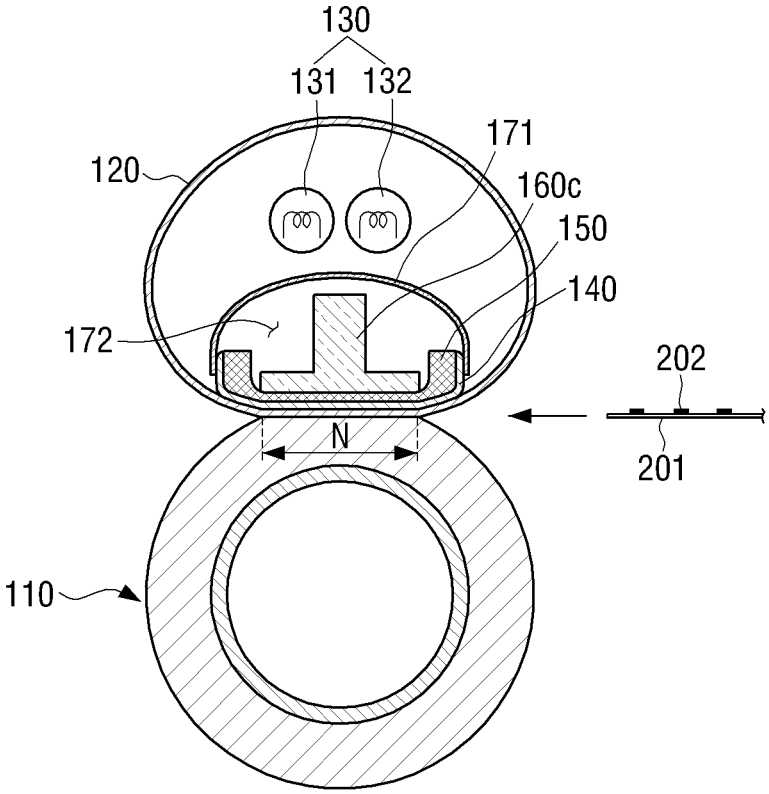

In FIG. 17, a reinforcement frame 160*c* has a T-shaped cross section. Although the reinforcement frame 160*c* has a shape different from that of the embodiment illustrated in FIG. 2A, the frame may still reinforce the stiffness of the support element 150 to obtain the uniform fixing nip N.

Figure 18:
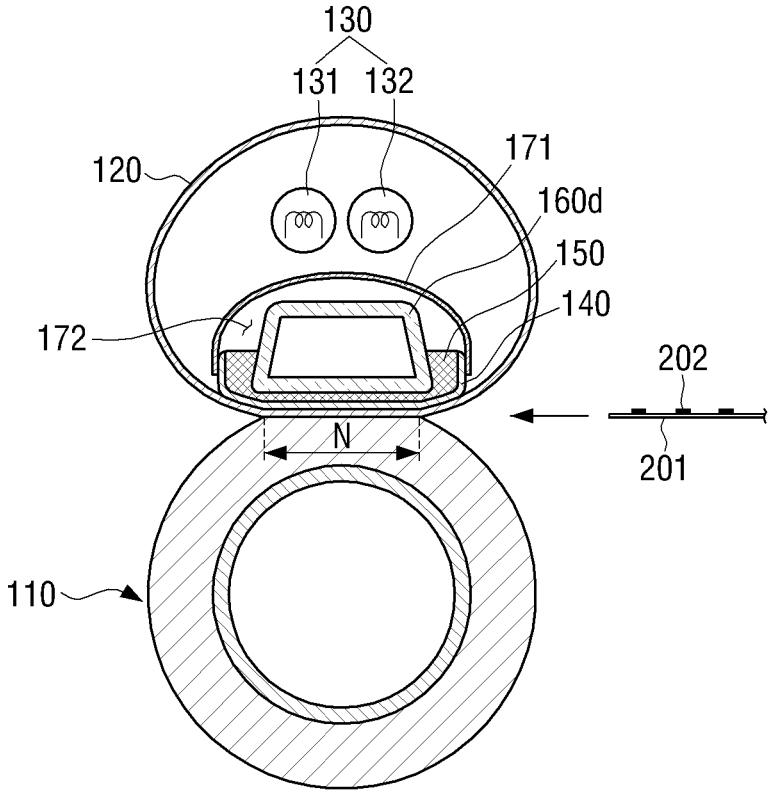
Figure 19:
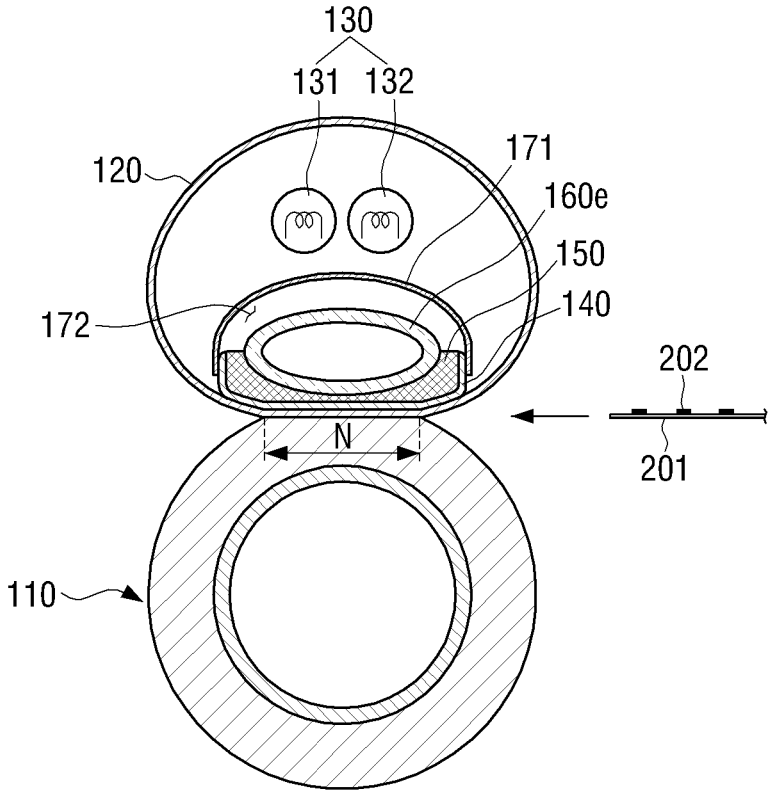
Figure 20:
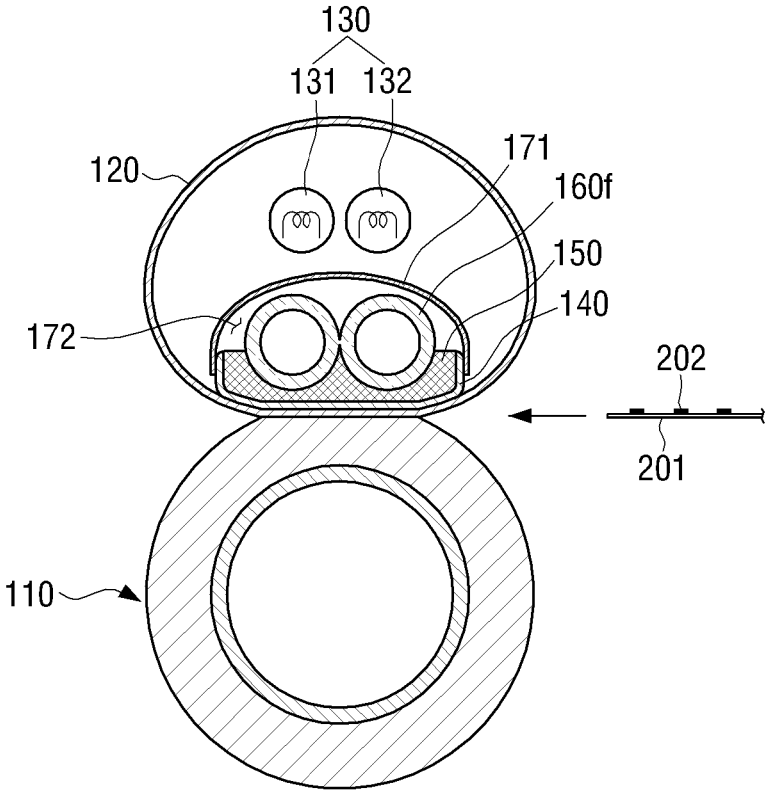
Figure 21:
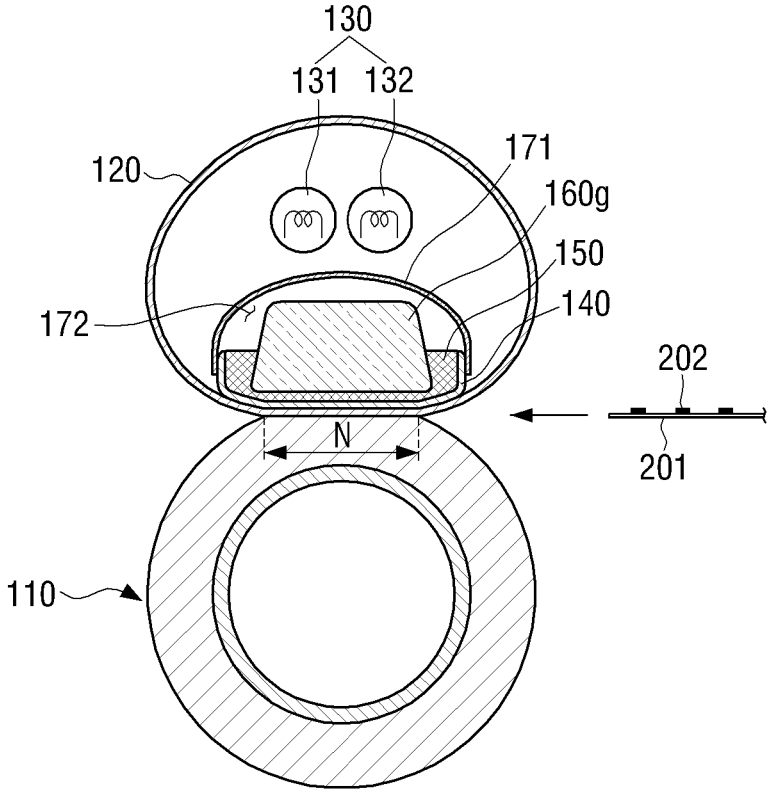

It can be appreciated that although the reinforcement frame 160 is shown as being solid in FIGS. 2, 15, 16, 17, 21 and 23-26, 29 and 31, the reinforcement frame may also have a hollow shape, i.e., the inside of reinforcement frame being empty, as illustrated in FIGS. 18-20, 22, 30 and 32. For example, an exemplary embodiment illustrated in FIG. 18 shows, a reinforcement frame 160*d* having a cross-section in the form of a tetragon where the inside of the reinforcement frame 160*d* is hollow. Although the reinforcement frame 160*d* of FIG. 18 has a shape different from that of the embodiment illustrated in FIG.2A, it may still reinforce the stiffness of the support element 150 to obtain the uniform fixing nip N. Alternatively, an alliterative embodiment illustrated in FIG. 21, shows a reinforcement frame 160 *g* is similar with that in the embodiment of FIG. 18, but different therefrom in that it has a solid shape, i.e., the inside being solid. Accordingly, the reinforcement frame 160*g* can greatly reinforce the stiffness of the support element 150.

In the embodiments of FIGS. 18 to 20, for example, an insulation material may be disposed in the empty space of the reinforcement frames 160*d*, 160*e*, and 160*f*.

It should be understood, however, that the embodiments of FIGS. 15 to 21 are merely illustrated by way of examples, and besides, the reinforcement frame 160 may be variously modified and embodied.

Figure 22:
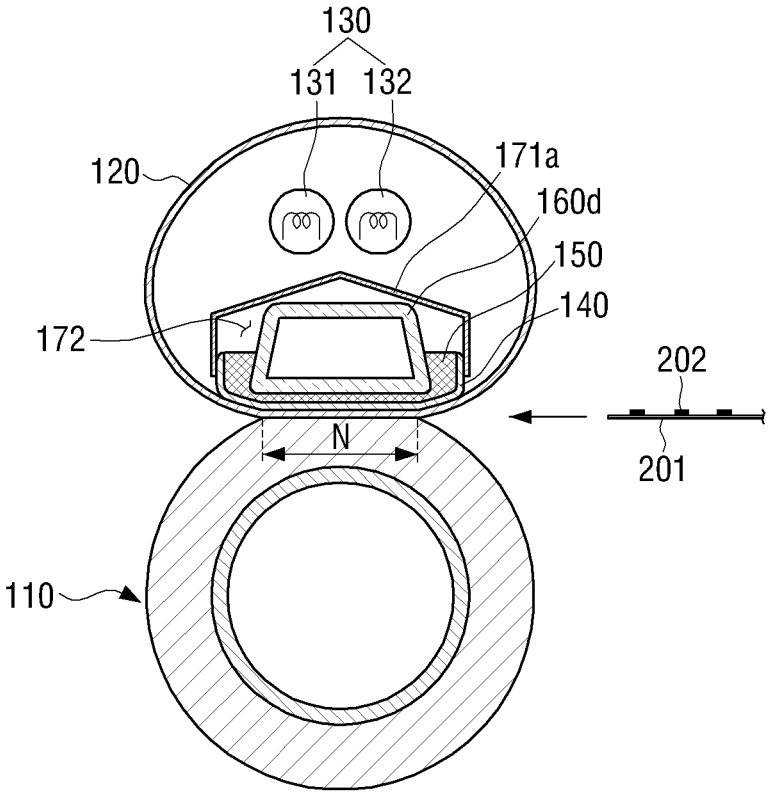
FIGS. 22 and 23 are views schematically illustrating modified embodiments of a reflection plate, respectively.
Figure 23:
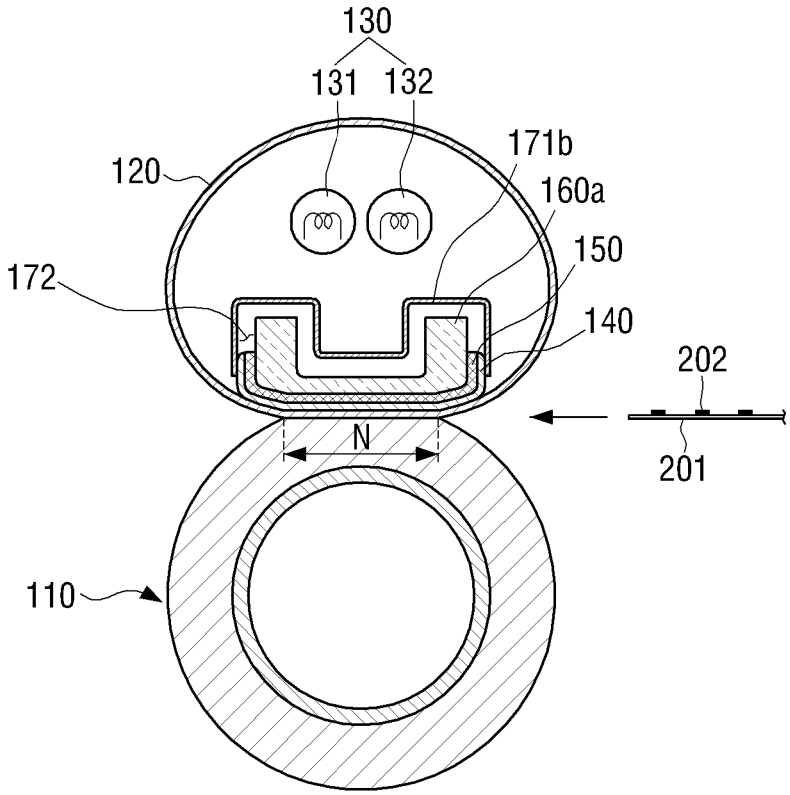

FIGS. 22 and 23 are views illustrating alternative embodiments of the reflection plate 171. The exemplary embodiment of FIG. 22 is similar with the embodiment of FIG. 18, but different therefrom in that a reflection plate 171*a* has a sectional shape in the form of a polygon. The embodiment of FIG. 23 is similar with the embodiment of FIG. 15, but a reflection plate 171*b* thereof has a sectional shape formed to correspond to the shape of the support element 150. For example, the reflection plate 171*b* of FIG. 23 has a U-shaped cross-section defining a first space 172 between the reflection plate 171*b* and the nip plate 140. Accordingly, a supporting element 150 having a similar U-shaped cross-section may be disposed between the reinforcement plate 171*b* and the nip plate 140. It should be understood that the embodiments of FIGS. 22 and 23 are merely illustrated by way of examples, and besides, the reflection plate 171 may be variously modified and embodied.

FIGS. 24 to 28 are views schematically illustrating modified embodiments of the heating unit 130, respectively.

Figure 24:
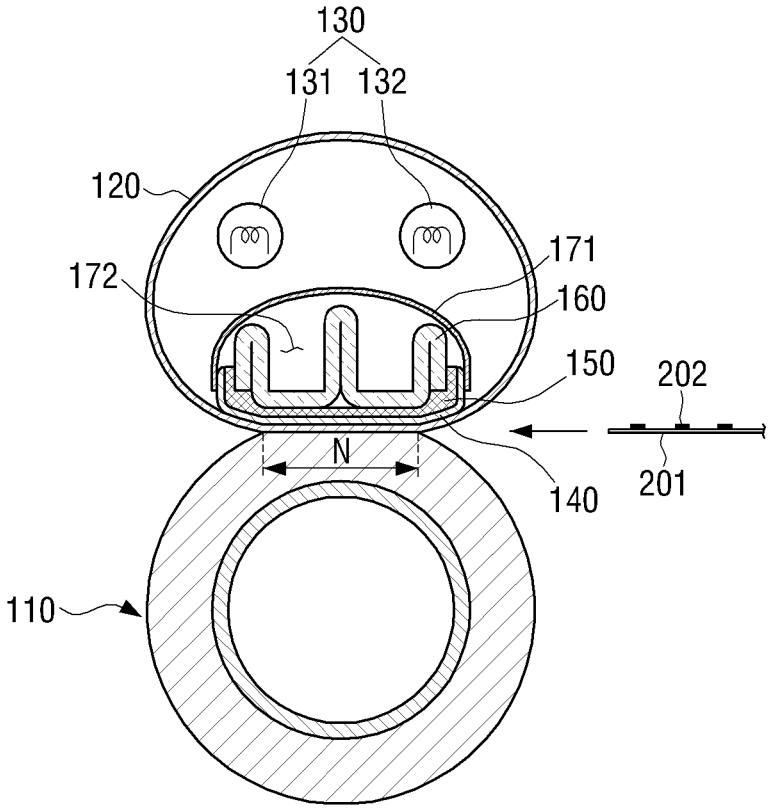
FIGS. 24 to 28 are views schematically illustrating modified embodiments of a heating unit, respectively.
Figure 25:
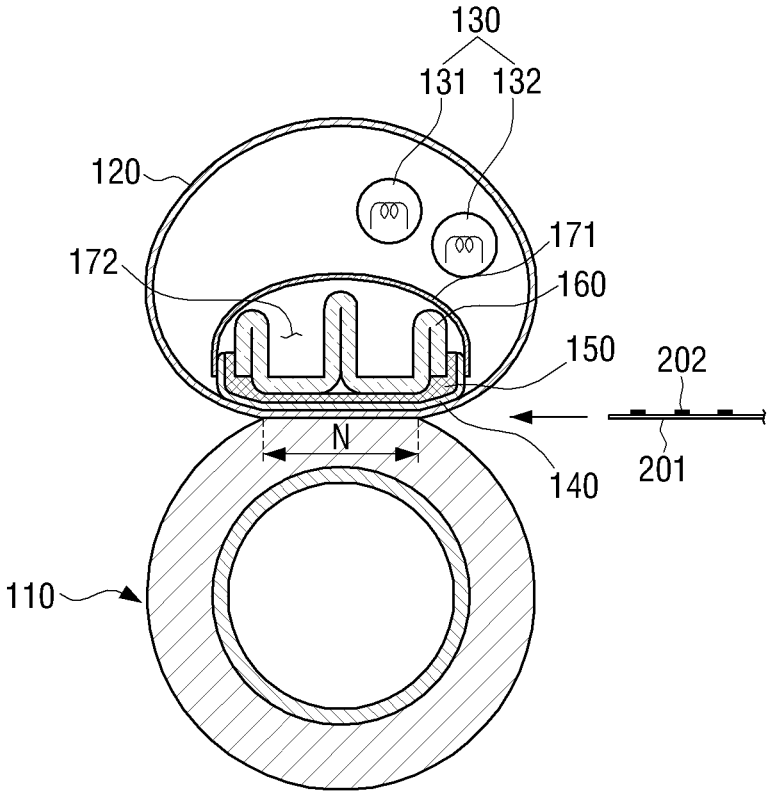
Figure 26:
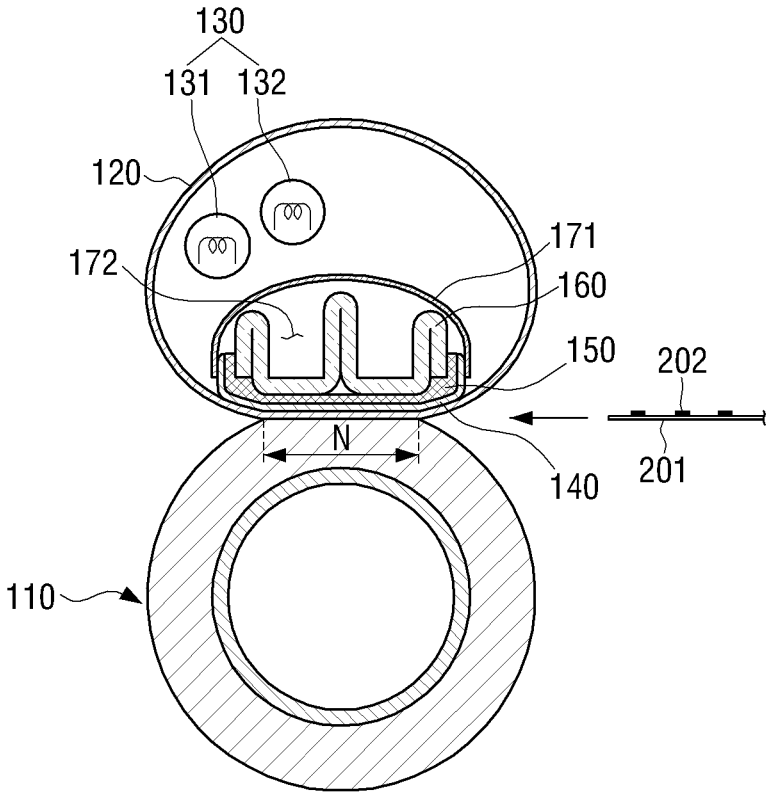

The embodiments of FIGS. 24 to 26 are similar to the embodiment of FIG. 2A, except that the first and the second heating lamps 131 and 132 are arranged differently. In the embodiment of FIG. 24, the first and the second heating lamps 131 and 132 are disposed to have a distance more apart from each other than that in the embodiment of FIG. 2A, For example, the first heating lamp 131 may be disposed to be biased toward the downstream of the fixing nip N, whereas the second heating lamp 132 may be disposed to be biased toward the upstream of the fixing nip N. Alternatively, an exemplary embodiment illustrated in FIG. 25 illustrates both the first heating lamp 131 and the second heating lamp 132 are disposed to be biased toward the upstream of the fixing nip N. In another exemplary embodiment illustrated embodiment of FIG. 26, both the first heating lamps 131 and the second heating lamp 132 are disposed to be biased toward the downstream of the fixing nip N.

Figure 27:
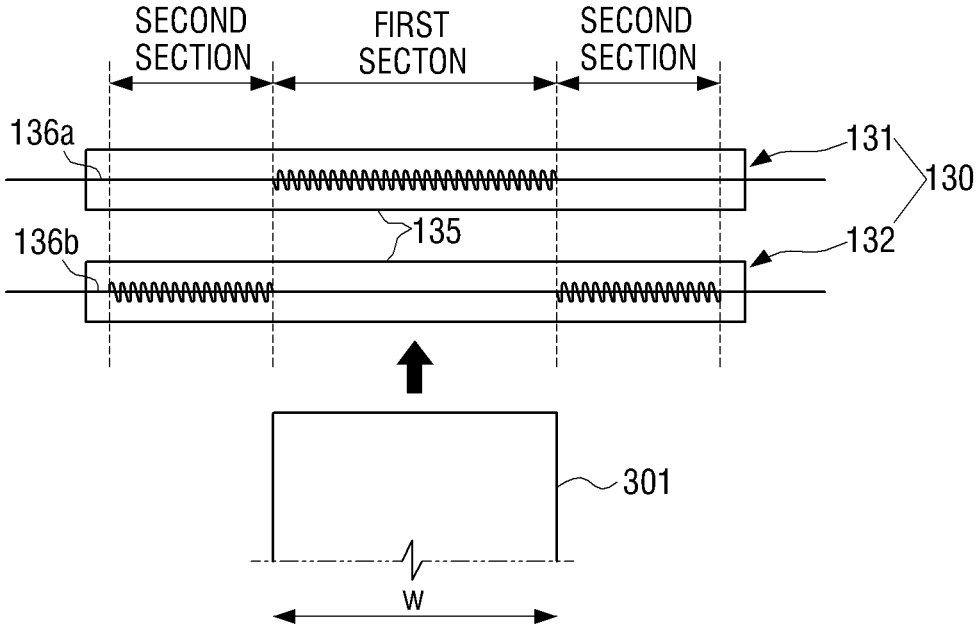
Figure 28:
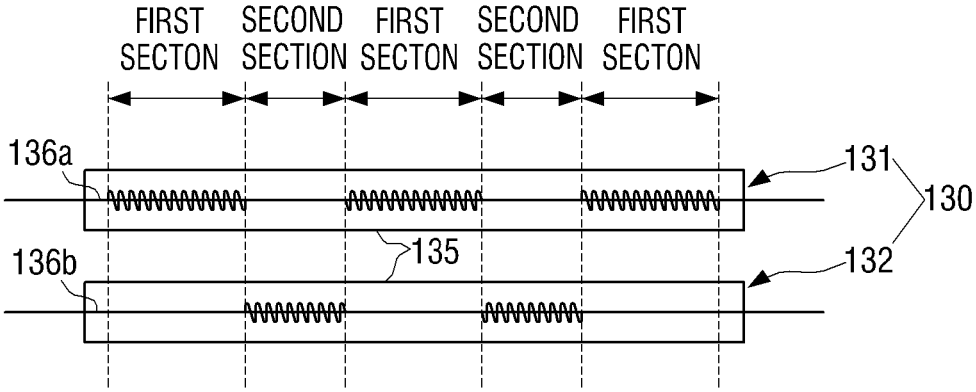

FIGS. 27 and 28 are views illustrating alternative winding states of the first and the second heating lamps 131 and 132, respectively.

In FIG. 27, a first filament 136*a* of the first heating lamp 131 is wound in a first section to form a coil, which corresponds to a portion of the print medium in a width direction thereof, while having a second section where the filament is not wound, i.e. the filament has a liner shape shaped as a straight line. Similarly, the second filament 136*b* of the second heating lamp 132 is wound in a second section to form a coil except the first section where the filament is not wound, i.e. has a linear shape. The image forming apparatus 1 may use print media having various sizes. For example, as illustrated in FIG. 27, a print medium 301 having a size smaller than a standard size may enter the fixing device 100. In this case, if the filament 136 is wound as in FIG. 4, a portion (that is, a portion corresponding to the second section) of the fixing belt 120 through which the smaller print medium 301 does not pass is ominous of being overheated, thereby causing an overheating phenomenon that results in inefficient use of heat and may cause damage to the fixing unit. This overheating phenomenon may result because a heat transfer from the portion to the smaller print medium 301 does not occur. However, in the embodiment as illustrated in FIG. 27, if the smaller print medium 301 enters the fixing device 100, the control unit 190 can operate only the first heating lamp 131 and stop an operation of the second heating lamp 132. Accordingly, the local overheating phenomenon as described above can be prevented.

In FIG. 27, the first section of the first filament 136*a* including a coil, i.e., in which the first filament 136*a* is wound, and the second section of the second filament 136*b* including a coil, i.e., in which the second filament 136*b* is wound, are completely separated and complementarily formed, but they may be partially overlapped within a certain range or may be spaced apart from each other.

In the embodiment of FIG. 28, first and second sections are more subdivided unlike the embodiment of FIG. 27. For example, FIG. 28 shows an alternative embodiment where a plurality of first and second sections corresponding to each of the first and second filaments 136*a*, 136*b* are shown. The first and second sections may be arranged in a staggered arrangement with respect to the first and second filaments 136*a*, 136*b*. More specifically, the first and second filaments 136*a*, 136*b* may extend in direction parallel to a width (W) of a printing medium, and the first and second heating lamps 131, 132 may be positioned such that the second filament 136*b* is disposed downstream from the first filament 136*a*. Accordingly, the first filament 136*a* may be arranged where the wound and linear sections alternate among one other along the first filament 136*a*, and the second filament 136*b* may be arranged where the wound and linear sections alternate among one other, but opposite with respect to the first filament 136*a*.

It should be understood that the embodiments of FIGS. 24 to 28 are merely illustrated by way of examples, and besides, the heating unit 130 may be variously modified and embodied.

FIGS. 29 to 32 are views schematically illustrating modified embodiments of the reflection unit 170, respectively.

Figure 29:
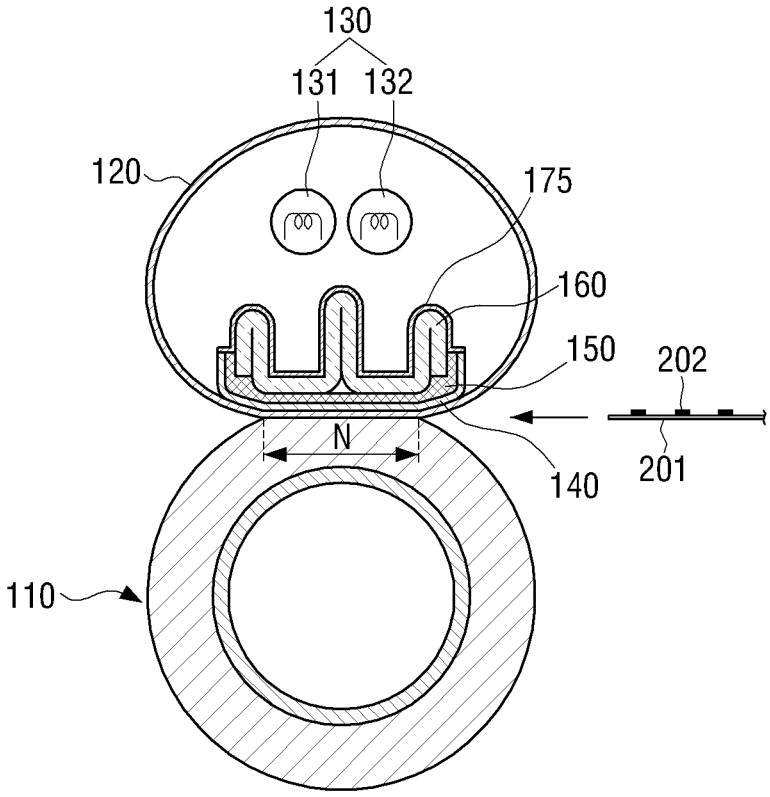
FIGS. 29 to 32 are views schematically illustrating modified embodiments of a reflection unit, respectively.

The embodiment of FIG. 29 is similar to the embodiment of FIG. 2A, but includes a reflection layer 175 formed on a surface of the reinforcement frame 160 facing the heating unit 130, and the reflection plate 171 is omitted. The reflection layer 175 reflects a heat radiated toward the reinforcement frame 160 and the support element 150 from the heating unit 130. Accordingly, the reflected heat can be used to heat the fixing belt 120. Also, the reflection layer 175 is connected to the nip plate 140 so that the heat can be conducted to the nip plate 140 from the reflection layer 175. Accordingly, as described above, it is possible to reduce the electric power consumption and the warm-up time. This reflection layer 175 may be made of a metal coating including, but not limited to, a nickel (Ni) coating layer and a nickel-chromium (Ni—Cr) coating layer formed by a coating process. Alternatively, a reflection layer 175 made by a separate process may be bonded to the reinforcement frame 160. In the embodiment of FIG. 29, since the reflection plate 171 is omitted, it is possible to reduce a weight of the fixing device 100 and simplify an assembling process.

Figure 30:
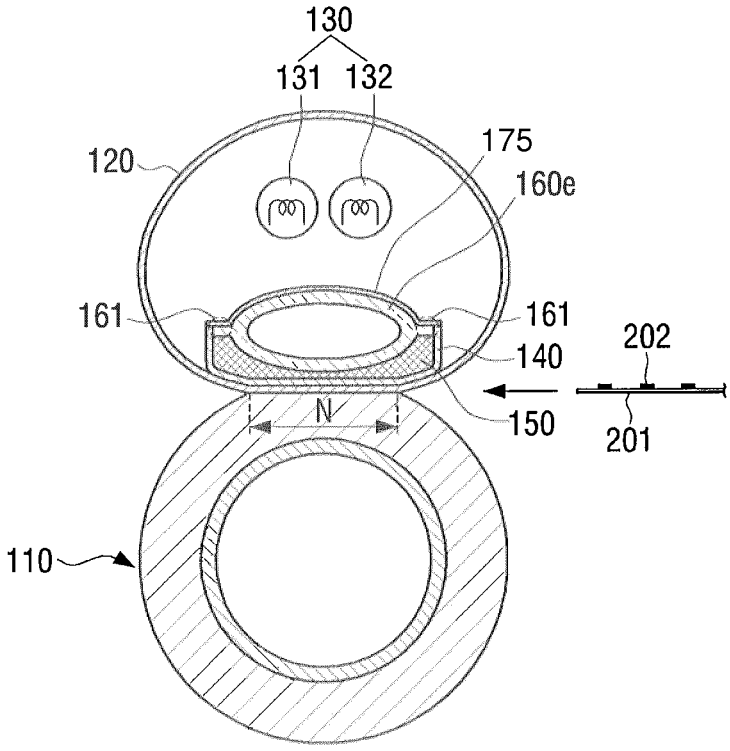
Figure 31:
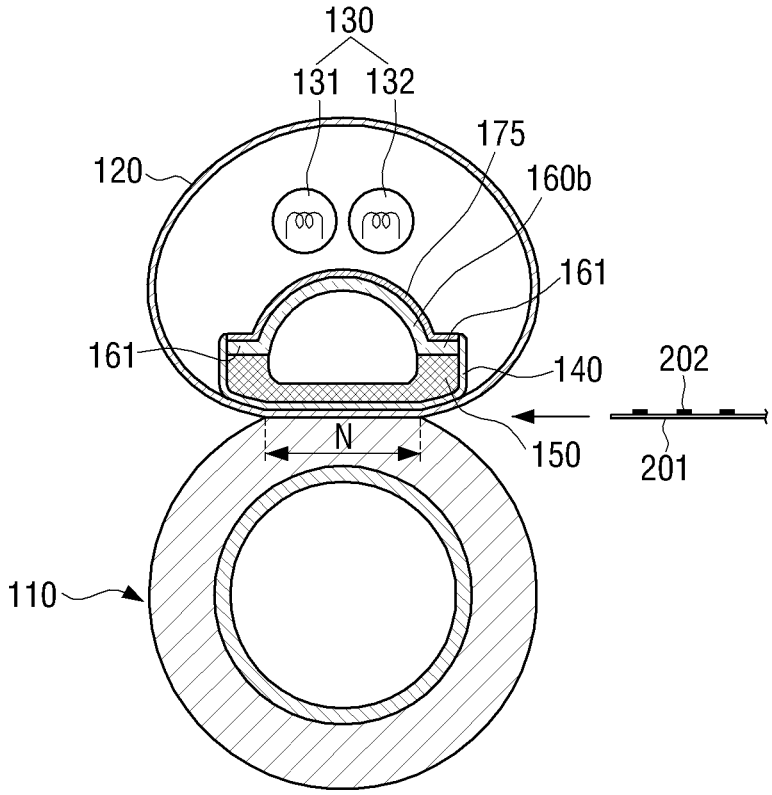

The exemplary embodiments of FIGS. 30 and 31 are similar to the embodiment of FIG. 19, but include a reflection layer 175 formed on the reinforcement frame 160, as opposed to providing a separate reflection plate 171. Also, a projecting part 161 is formed on the reinforcement frame 160*e* to cover a surface of the support element 150 toward the heating unit 130. Accordingly, the coating layer 175 is formed by the coating process, which allows the reflection layer 175 to be easily formed on the reinforcement frame 160*e* made of a metal material. However, it can be appreciated that the projecting part 161 may not be formed on the reinforcement frame 160*e*.

Figure 32:
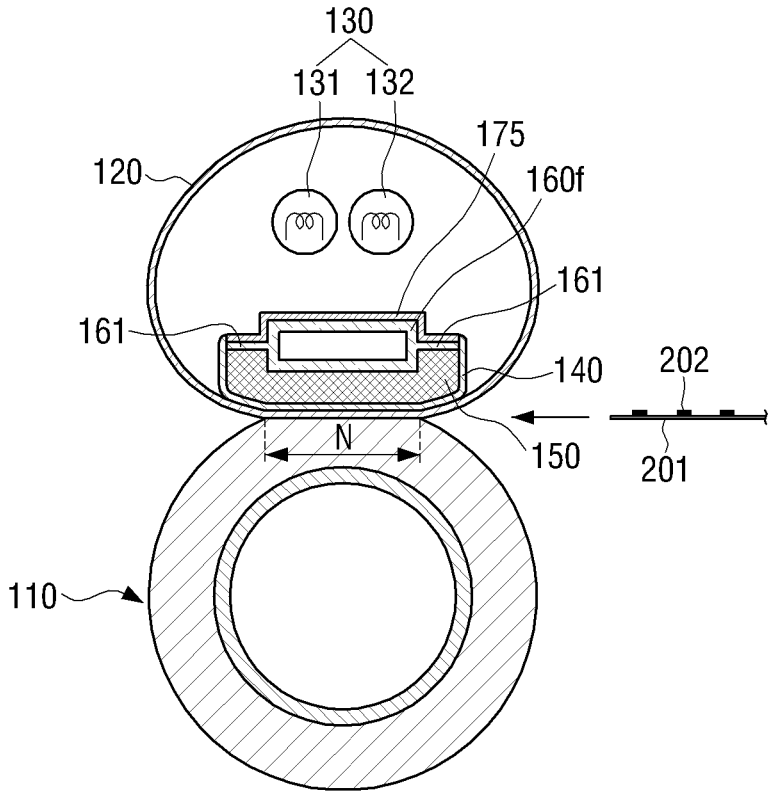

In further regard to FIG. 32, the reflection plate 171 is omitted and a reflection layer 175 is formed on a surface of a reinforcement frame 160*f*. The reinforcement frame 160*f* has a hollow shape, the inside of which is empty. A sectional form of the reinforcement frame 160*f* is a rectangle. A projecting part 161 is formed on the reinforcement frame 160*f* to cover a surface of the support element 150 toward the heating unit 130.

Figure 33:
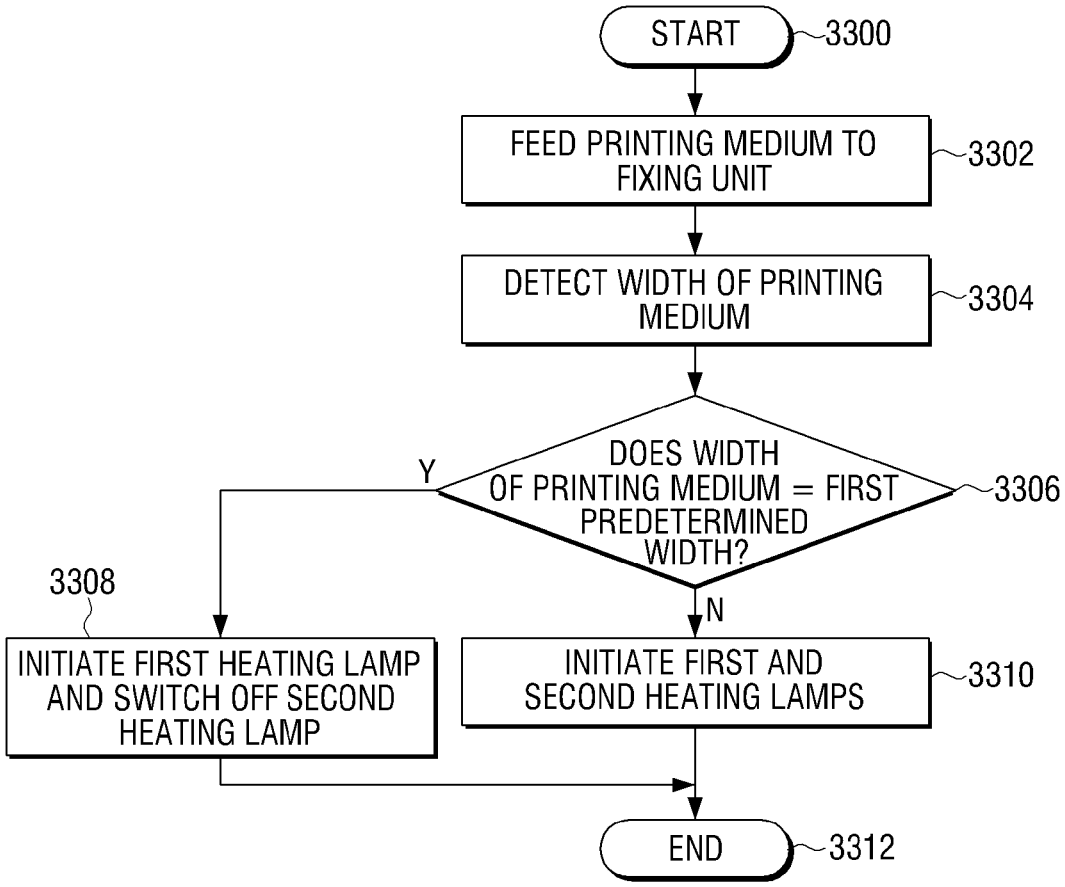
FIG. 33 is a flowchart illustrating an exemplary method of heating a printing medium fed to a fixing unit according to the general inventive concept.

Referring now to FIG. 33, an exemplary method of heating a printing medium to fix toner thereto is illustrated. The method begins at operation 3300, and proceeds to operation 3302 where a printing medium is conveyed to a fixing nip of a fixing unit. In operation 3304, a width of the printing medium may be detected via a sensor. In operation 3306, the detected width of the printing medium is compared to a predetermined width value. For example, a control module may compare the width detected by the sensor to a width value stored in the control module. When the detected width equals and/or is less than a predetermined width value, the method proceeds to operation 3308 where a first heating lamp is switched on i.e. initiated, to generate heat therefrom, while a second heating lamp is switched off to inhibit heat therefrom and the method ends at operation 3312. Alternatively, when width detected in operation 3306 does not equal the first predetermined width and/or equals a second predetermined width value, both the first and second heating lamps are initiated in operation 3310, and the method ends at operation 3312. Accordingly, a sufficient amount of heat may be generated corresponding to a size of printing medium fed to the fixing unit, while preventing an overheating phenomenon discussed above.

Although a few embodiments of the present general inventive concept have been shown and described, it would be appreciated by those skilled in the art that changes may be made in these embodiments without departing from the principles and spirit of the general inventive concept, the scope of which is defined in the claims and their equivalents.

What is claimed is:

1. A fixing device comprising:

a fixing belt including a hollow opening to define an inner surface to receive heat and outer surface to transmit the heat to a print medium;

a pressing unit to apply a pressure on the print medium;

a heating unit disposed within the hollow opening of the fixing belt to generate the heat;

a nip plate disposed within the fixing belt to face the pressing unit, thus to form a fixing nip;

a support element to support the nip plate;

a reinforcement frame to reinforce a stiffness of the support element; and a reflection unit disposed within the fixing belt to reflect the heat radiated toward the support element from the heating unit, the reflection unit formed to reflect the heat toward the inner surface of the fixing belt and to block the heat from going toward the nip plate, wherein the reflection unit is connected with the nip plate to conduct the heat from the reflection unit to the nip plate, and the heating unit is disposed between the fixing belt and the reflection unit.

2. The device of claim 1, wherein a coating layer is formed on a surface of the nip plate coming in contact with the fixing belt to reduce a friction therebetween.

3. The device of claim 2, wherein the coating layer of the nip plate comprises a Polytetrafluoroethylene (PTFE) coating layer.

4. The device of claim 1, wherein the nip plate is formed of an aluminum.

5. The device of claim 1, wherein the support element is formed of a nonmetallic material with low thermal conductivity.

6. The device of claim 1, wherein the reflection unit comprises a reflection plate to cover the support element, and a first space is formed between the reflection plate and the support element.

7. The device of claim 6, wherein a surface of the reflection plate toward the heating unit is mirror-like-finished.

8. The device of claim 6, wherein a reflection coating layer is formed on a surface of the reflection plate toward the heating unit.

9. The device of claim 8, wherein the reflection coating layer of the reflection plate comprises a Ni coating layer or a Ni—Cr coating layer.

10. The device of claim 6, wherein an insulation material is disposed in the first space.

11. The device of claim 6, wherein the reflection plate is formed of a reflective aluminum plate.

12. The device of claim 1, wherein the reflection unit comprises a reflection layer formed on a surface of the reinforcement frame toward the heating unit.

13. The device of claim 12, wherein the reflection layer comprises a Ni-coating layer or a Ni—Cr coating layer.

14. The device of claim 12, wherein the reinforcement frame covers a surface of the support element facing the heating unit.

15. The device of claim 1, wherein the reinforcement frame is made from at least one of a steel, a steel use stainless (SUS), an aluminum and a copper.

16. The device of claim 1, wherein a second space is formed between the reinforcement frame and the support element.

17. The device of claim 16, wherein an insulation material is disposed in the second space.

18. The device of claim 1, further comprising:

a sensor unit to measure a temperature of the fixing belt; and a control unit to control the heating unit based on the temperature of the fixing belt measured by the sensor unit.

19. The device of claim 18, wherein the sensor unit measures a temperature of an inner circumferential surface of the fixing belt, and the reflection unit cuts off a heat radiated toward the sensor unit from the heating unit.

20. The device of claim 19, wherein the sensor unit comprises:

a temperature measuring part disposed to penetrate through the support element and the nip plate and to come in contact with the inner circumferential surface of the fixing belt; and a signal connecting line to connect the temperature measuring part and the control unit.

21. The device of claim 1, wherein the heating unit comprises a plurality of heating lamps, and the plurality of heating lamps comprises a first heating lamp and a second heating lamp, a filament of the first heating lamp being wound in a first section, which corresponds to a portion of the print medium in a width direction of the print medium, and a filament of the second heating lamp being wound in a second section except the first section.

22. An image forming apparatus comprising:

a photosensitive body;

a charging unit to electrify the photosensitive body;

an optical scanning unit to scan a light onto the photosensitive body thus to form an electrostatic latent image on the photosensitive body;

a developing unit to supply a toner onto the photosensitive body on which the electrostatic latent image is formed, thus to form a toner image on the photosensitive body;

a transfer unit to transfer the toner image formed on the photosensitive body onto a print medium; and a fixing device to fix the toner image transferred onto the print medium, wherein the fixing device comprises:

a fixing belt to transmit a heat to the print medium;

a pressing unit to apply a pressure on the print medium;

a heating unit disposed within the fixing belt to generate the heat;

a nip plate disposed within the fixing belt to face the pressing unit, thus to form a fixing nip;

a support element to support the nip plate;

a reinforcement frame to reinforce a stiffness of the support element; and a reflection unit disposed within the fixing belt to reflect the heat radiated toward the support element from the heating unit, the reflection unit formed to reflect the heat toward the inner surface of the fixing belt and to block the heat from going toward the nip plate, wherein the reflection unit is connected with the nip plate to conduct the heat from the reflection unit to the nip plate, and the heating unit is disposed between the fixing belt and the reflection unit.

23. The device of claim 1, wherein the reflection unit and the nip plate are connected with each other by using an engagement fastening method using a hook or a screw fastening method using a screw.

* * * * *